US008096150B2

(12) United States Patent
Lai et al.

(10) Patent No.: US 8,096,150 B2
(45) Date of Patent: Jan. 17, 2012

(54) PADLOCKS FOR HOLDING AND SECURING ZIPPER PULLS

(75) Inventors: Eric Lai, Tai Po (HK); Karl Lai, Tai Po (HK)

(73) Assignee: The Sun Lock Company Ltd., Tuen Mun N.T. (HK)

( * ) Notice: Subject to any disclaimer, the term of this patent is extended or adjusted under 35 U.S.C. 154(b) by 670 days.

(21) Appl. No.: 11/973,169

(22) Filed: Oct. 5, 2007

(65) Prior Publication Data

US 2008/0087049 A1 Apr. 17, 2008

Related U.S. Application Data

(60) Provisional application No. 60/852,030, filed on Oct. 16, 2006, provisional application No. 60/875,465, filed on Dec. 18, 2006.

(51) Int. Cl.
*E05B 37/14* (2006.01)

(52) U.S. Cl. ..... 70/21; 70/68; 70/71; 70/284; 70/285

(58) Field of Classification Search ..... 70/21, 68–72, 70/74, 284, 285, DIG. 63, DIG. 71
See application file for complete search history.

(56) References Cited

U.S. PATENT DOCUMENTS

| | | | | | |
|---|---|---|---|---|---|
| 1,377,737 | A * | 5/1921 | Stosech | 70/284 |
| 3,408,839 | A * | 11/1968 | Walters | 70/285 |
| 4,416,126 | A * | 11/1983 | Remington | 70/71 |
| 4,557,122 | A * | 12/1985 | Hwang | 70/312 |
| 5,000,019 | A * | 3/1991 | Foster | 70/338 |
| 5,211,040 | A * | 5/1993 | Gisiger | 70/71 |
| 5,265,454 | A * | 11/1993 | Crocco et al. | 70/380 |
| 5,485,734 | A * | 1/1996 | Yang | 70/285 |
| 5,557,954 | A * | 9/1996 | Ling | 70/68 |
| 5,689,979 | A * | 11/1997 | Yu | 70/69 |
| 5,868,012 | A * | 2/1999 | Chun-Te et al. | 70/30 |
| 5,927,110 | A * | 7/1999 | Yu | 70/68 |
| 5,927,113 | A * | 7/1999 | Yu | 70/312 |
| 6,065,313 | A * | 5/2000 | Huang | 70/68 |
| 6,202,455 | B1 * | 3/2001 | Su | 70/68 |
| 6,314,774 | B1 * | 11/2001 | Andersson | 70/358 |
| 6,408,660 | B1 * | 6/2002 | Lai | 70/30 |
| 6,568,225 | B1 * | 5/2003 | Chang | 70/69 |
| 6,807,832 | B1 * | 10/2004 | Jeng | 70/68 |
| 6,912,880 | B2 * | 7/2005 | Ling et al. | 70/71 |
| 7,104,092 | B2 * | 9/2006 | Yu | 70/21 |
| 7,331,204 | B1 * | 2/2008 | Hsieh | 70/69 |
| 7,415,853 | B2 * | 8/2008 | Yu | 70/68 |
| 2007/0214850 | A1 * | 9/2007 | Ma | 70/284 |
| 2008/0000277 | A1 * | 1/2008 | Yu | 70/432 |
| 2008/0236212 | A1 * | 10/2008 | Ma | 70/77 |

* cited by examiner

*Primary Examiner* — Lloyd Gall
(74) *Attorney, Agent, or Firm* — Alfred A. Fressola; Ware, Fressola, Van Der Sluys & Adolphson LLP

(57) ABSTRACT

By providing two separate and independent locking system formed in a single padlock construction which is employed for securely holding and locking zipper pull tabs, an effective, easily produced, padlock is achieved which is responsive to both a combination controlled locking system and a key controlled locking system for independently enabling the zipper pull tabs to be released and/or lockingly engaged in response to the activation of either locking system. In the present invention, an easily assembled, compact, highly efficient dual mode, zipper pull locking system is achieved by employing a pair of spring biased locking latch members which are constructed for being inserted in the apertures formed in each of the conventional zipper pulls/tabs employed on luggage, briefcases, and the like.

15 Claims, 34 Drawing Sheets

PADLOCKS FOR HOLDING AND SECURING ZIPPER PULLS

RELATED APPLICATIONS

This application is related to U.S. Provisional Patent Application Ser. No. 60/852,030, filed Oct. 16, 2006 entitled PADLOCKS FOR HOLDING AND SECURING ZIPPER PULLS, and U.S. Provisional Patent Application Ser. No. 60/875,465, filed Dec. 18, 2006 entitled PADLOCKS FOR HOLDING AND SECURING ZIPPER PULLS.

TECHNICAL FIELD

This invention relates to padlocks and lock systems and, more particularly, to padlocks constructed for holding and securing zipper pulls.

BACKGROUND ART

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. Although locks of this general nature have been available for several decades and have been constructed in a wide variety of forms and shapes, these prior art combination lock constructions suffer from common deficiencies which have not been successfully overcome.

In most prior art constructions, combination padlocks incorporate a J-shaped or U-shaped shackle which is employed to provide the desired engagement with the suitcase or items to be locked. In one of the most popular applications, the shackle is inserted through apertures formed in the zipper pulls which are mounted to the suitcase in order to maintain the suitcase in the secured and locked position. Although most suitcases, or similar products, which incorporate zippers for maintaining cooperating portions thereof in the closed position are locked by the owner using padlocks incorporating J-shaped or U-shaped shackles, one group of products which has recently become popular are lock constructions designed for independently receiving and securing the two separate and independent zipper pulls mounted to a suitcase, or similar product. In this way, a suitcase or similar product can be securely locked using a padlock construction which is more easily integrated into the body of the suitcase, as opposed to being a separate and independent element which hangs from the product.

Although the combination padlocks constructed for receiving and securing zipper pulls directly therein incorporate a construction which is readily distinguishable from prior art padlocks incorporating conventional shackles, the prior art problems associated with rotatable dial/shackle padlocks is typically identical to the prior art problems associated with rotatable dial/zipper pull padlocks. As a result, many manufacturers have attempted to solve the problems associated with rotatable dial or combination locks.

One principal difficulty and drawback found in these prior art constructions which has not been overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

In addition, although key operated locks do not suffer from the difficulty of having the combination changed or altered without the user's knowledge, users are frequently incapable of using key operated locks, due to the key being lost or misplaced. As a result, prior art key operated locks are also frequently discarded due to the user's inability to find a particular key for operating the lock.

Another common problem which has consistently plagued prior art constructions is the cost of construction for producing and assembling prior art padlocks, whether the padlock is key operated or combination operated. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal component of the lock, thereby causing damage to these components or interfering with the ease of operating the lock by an individual who either knows the actual combination or has the activating key. Although numerous attempts have been made to reduce the adverse effects caused by contaminants reaching these components, such attempts have been incapable of completely eliminating in this problem.

A final, still further difficulty, which has recently arisen and affects both combination locks and key operated locks, is a requirement that all secured locks must be broken by Customs officers, and/or inspection or security personnel in order to gain access to luggage which is deemed suspicious. Under new security regulations that has been implemented, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any lock which may be on the luggage.

Consequently, with these new regulations presently implemented, all prior art lock systems which are incapable of being opened by inspectors and/or security personnel are subject to be physically broken, in order to gain access to any luggage which needs to be visually inspected. As a result, consumers will now be faced with the possibility that any lock system employed to protect the contents of a suitcase can be physically removed by security personnel, leaving the luggage completely unprotected during the remainder of the trip.

Furthermore, further new regulations have been implemented requiring lock manufacturers who produce key operated locks for use by security personnel must employ constructions which enable the key to be removed when the lock is in the open position. This additional regulation has further complicated the construction of prior art padlocks as well as adding additional difficulties to the typical operation of key operated padlocks.

In addition, some prior art padlocks have been constructed which do provide a dual locking system for enabling security personnel to gain access to the lock, when necessary. However, these prior art dual locking padlock systems are typically limited to only padlocks incorporating J-shaped or U-shaped shackles. Dual locking padlocks constructed for securing zipper pulls to the lock system have not been created and leave such padlocks vulnerable to being broken by security personnel whenever inspection is required of a suitcase employing these locks.

Therefore, it is a principal object of the present invention to provide a padlock system having a fully integrated dual locking construction which is configured for securing the zipper pulls of a suitcase thereto.

Another object of the present invention is to provide a dual locking, zipper pull padlock having the characteristic features described above which is easily produced and provides the user with complete control over resetting the combination employed therein.

Another object of the present invention is to provide a dual locking, zipper pull padlock having the characteristic features described above which is easily produced in a cost effective manner.

Other and more specific objects will in part be obvious and will in part appear hereinafter.

SUMMARY OF THE INVENTION

By employing the present invention, all of the difficulties and drawbacks found in prior art constructions are essentially eliminated and an effective, easily produced, padlock is achieved which incorporates two separate and independent locking systems formed in a single padlock construction which is employed for securely holding and locking zipper pull tabs. In addition, a unique construction is provided which is responsive to both a combination controlled locking system and a key controlled locking system for independently enabling the zipper pull tabs to be released and/or lockingly engaged in response to the activation of either locking system. In this way, by using the key activating portion, a user is assured of the ability to release the zipper pull tabs from locked engagement with the housing of the padlock, while also assuring the user is able to release the zipper pull tabs from locked engagement with the housing by employing the combination controlled portion.

In accordance with the present invention, a single housing is employed and constructed for enabling the zipper pulls to be secured thereto or released therefrom using either a rotatable dial combination construction or a key activated tumbler construction. In this way, a dual locking and releasing padlock is achieved which virtually eliminates the difficulties typically encountered with known prior art constructions. In addition, the present invention satisfies all new regulations regarding security inspection of luggage as well as all previously existing regulations.

In accordance with the present invention, an easily assembled, compact, highly efficient dual mode, zipper pull locking system is achieved by employing a pair of spring biased locking latch members which are constructed for being inserted in the apertures formed in each of the conventional zipper pulls/tabs employed on luggage, briefcases, and the like. In addition, the movement of the locking latch members is controlled by a movable control plate in association with cooperating elements which are activated by either use of the combination controlled locking section or the key controlled locking section. In this way, all of the goals and objectives of the present invention are achieved.

In one embodiment of the present invention, the two locking latch members are constructed for being moved simultaneously, thereby releasing both zipper pull tabs at the same time. In a second embodiment of the present invention, the user is able to separately control the locking latch members, thereby releasing one zipper pull tab or both zipper pull tabs, if so desired. In this way, a high degree of flexibility is realized.

As stated above, new regulations have been enacted which affects luggage and other products, that must be scanned by security personnel in airports. In accordance with these new regulations, all padlocks must be capable of releasing the key controlled portion when the padlock has been opened by the security personnel. Presently, padlock constructions require the padlock to be affixed to the luggage and relocked prior to enabling the security personnel to remove the key therefrom. However, these new regulations require alternate constructions which will enable the key to be removed even when the padlock is open.

In accordance with the zipper pull locking system of the present invention, the key controlled portion of the locking system is constructed in a manner which enables the key to be removed even when the zipper pulls have been released and the lock is in the open position. As a result, all of these new regulations and requirements are fully satisfied.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the present invention, reference should be had to the following detailed description taken in connection with the accompanying drawings, in which:

FIG. 40A is a side elevation view of the blocking plate embodiment depicted in FIG. 39A; and FIG. 40B is a perspective view of the blocking plate and embodiment of FIG. 40A.

DETAILED DISCLOSURE

Figure 2:
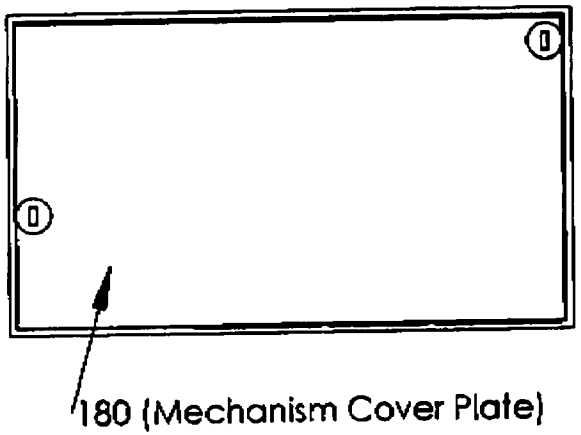
FIG. 2 is a bottom plan view of the dual mode, zipper pull locking system of FIG. 1.
Figure 1:
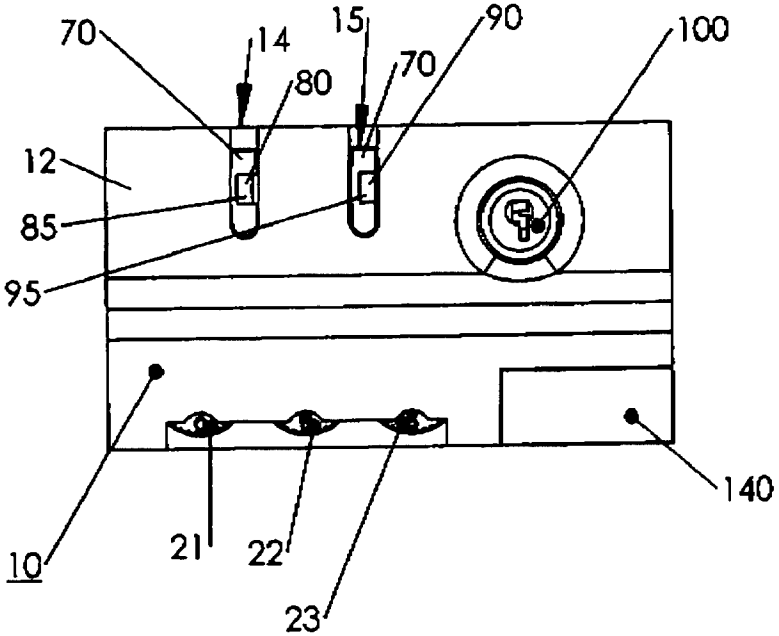
FIG. 1 is a top plan view of one preferred embodiment of the dual mode, zipper pull locking system of the present invention.
Figure 3A:
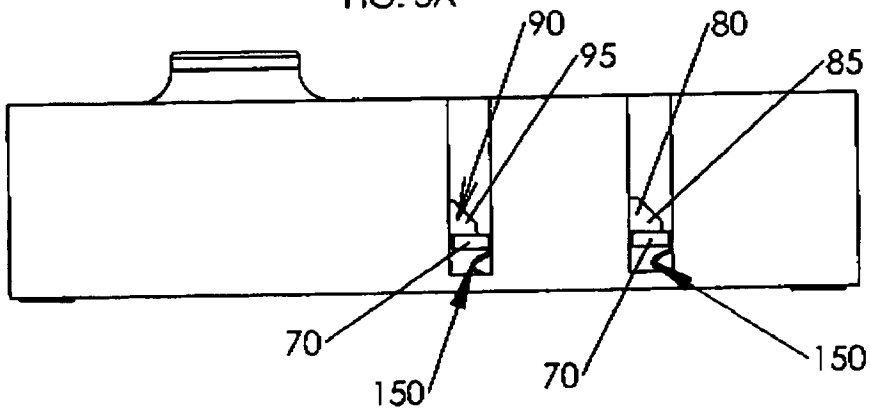
FIG. 3A is a side elevation view of the dual mode, zipper pull locking system of FIG. 1.
Figure 3B:
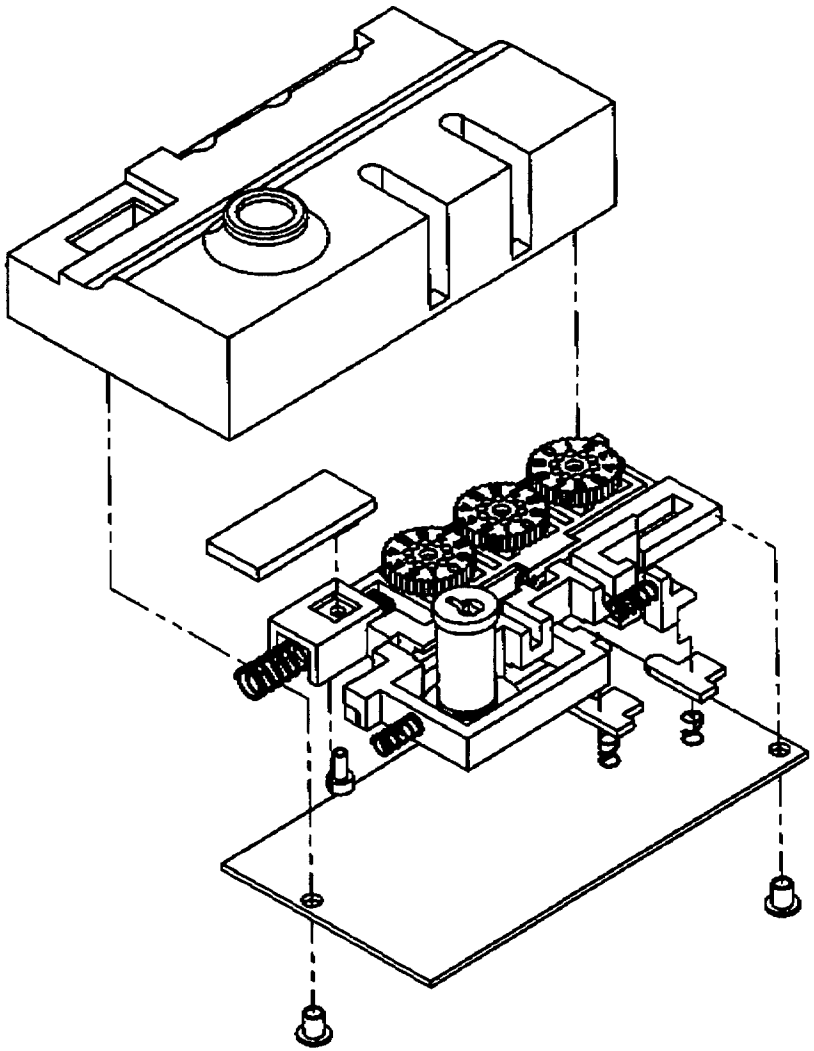
FIG. 3B is an exploded perspective view of the dual mode, zipper pull locking system of FIG. 1.
Figure 4A:
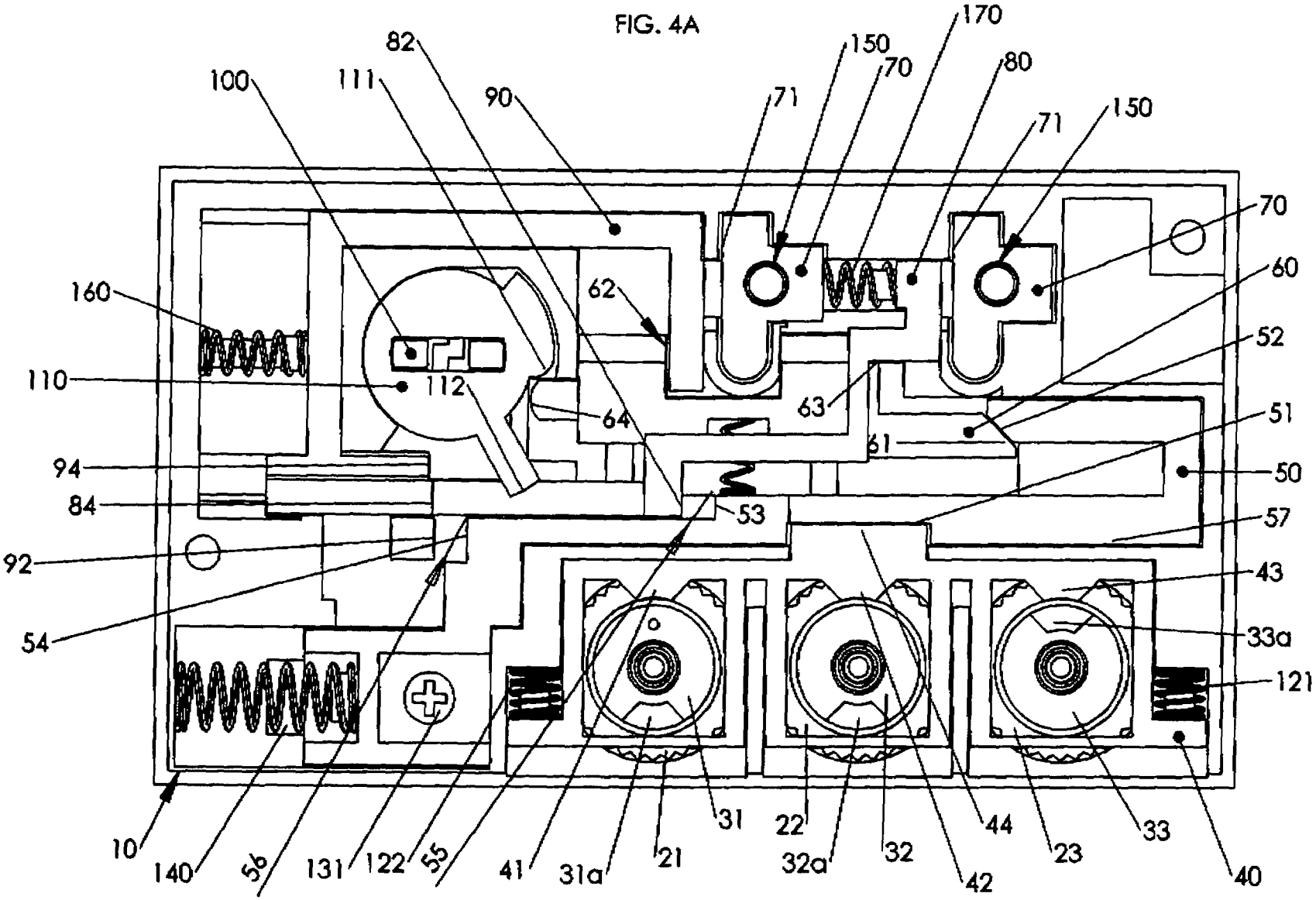
FIGS. 4A and 4B are bottom plan views of the dual mode, zipper pull locking system of FIG. 1 with the bottom cover removed and shown in the locked position.
Figure 4B:
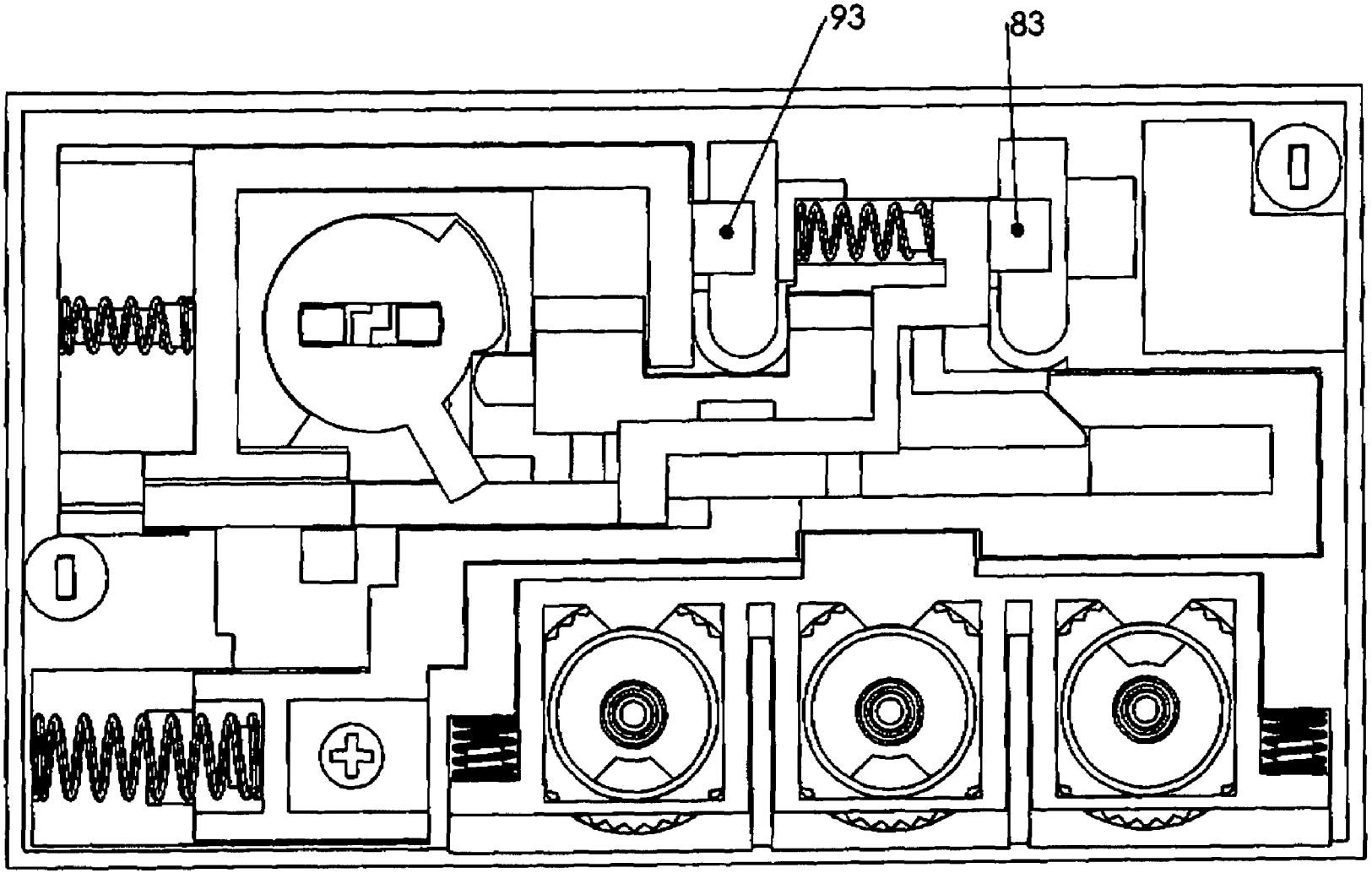
Figure 5:
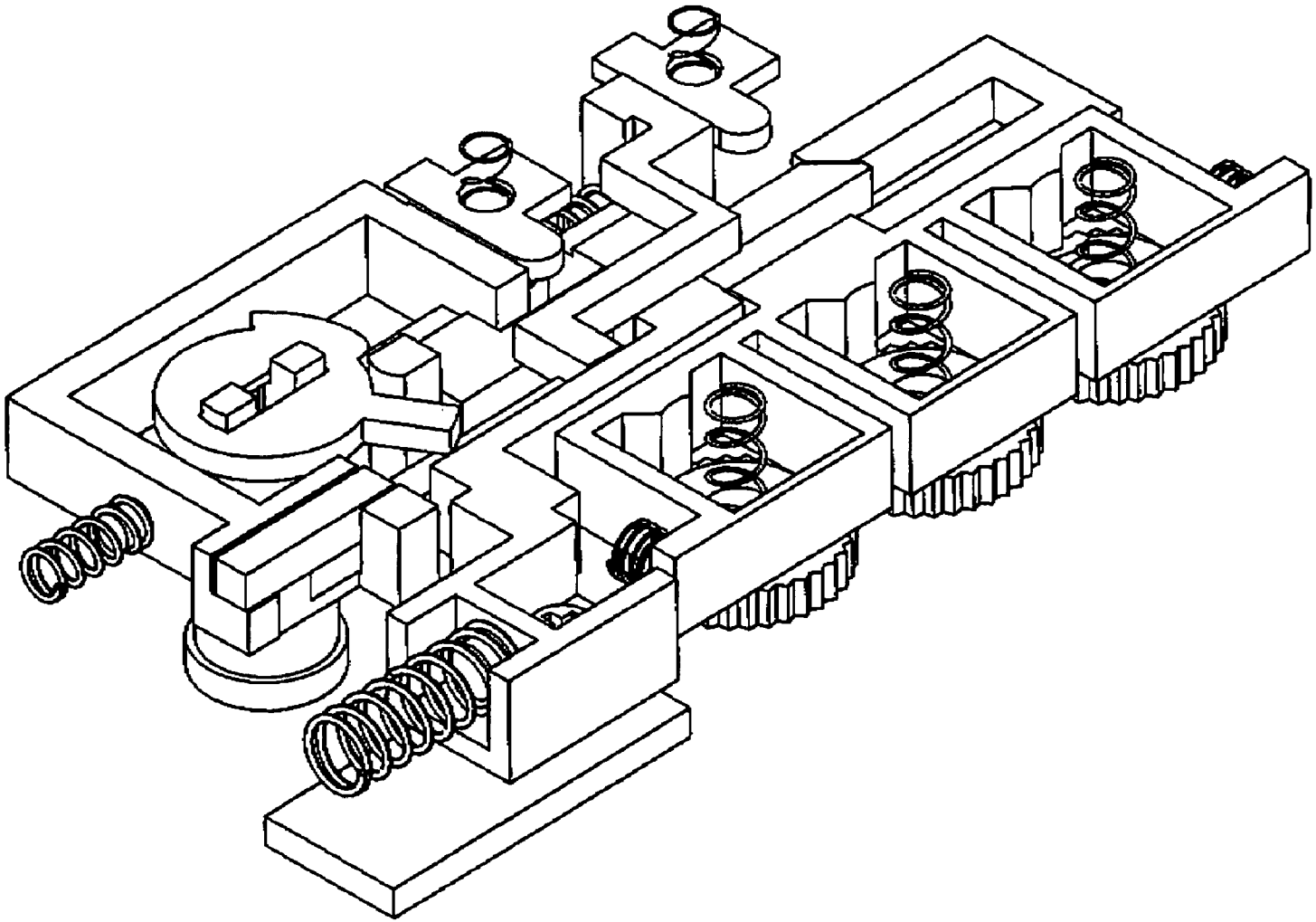
FIG. 5 is a bottom perspective view of the dual mode, zipper pull locking system of FIG. 1 shown with the housing removed.
Figure 6:
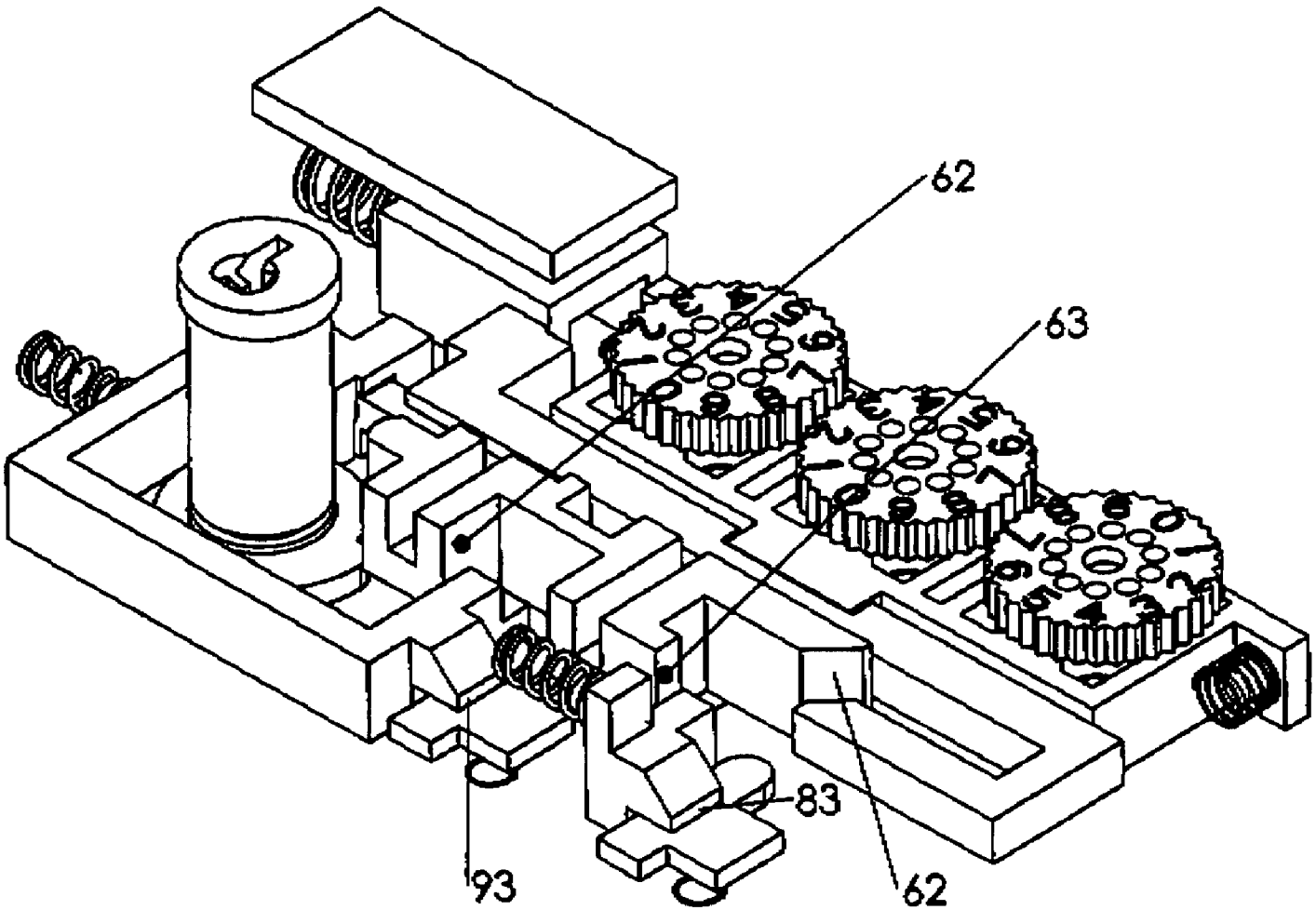
FIGS. 6 and 7 are front perspective views of the dual mode, zipper pull locking system of FIG. 1 shown with the housing removed.
Figure 7:
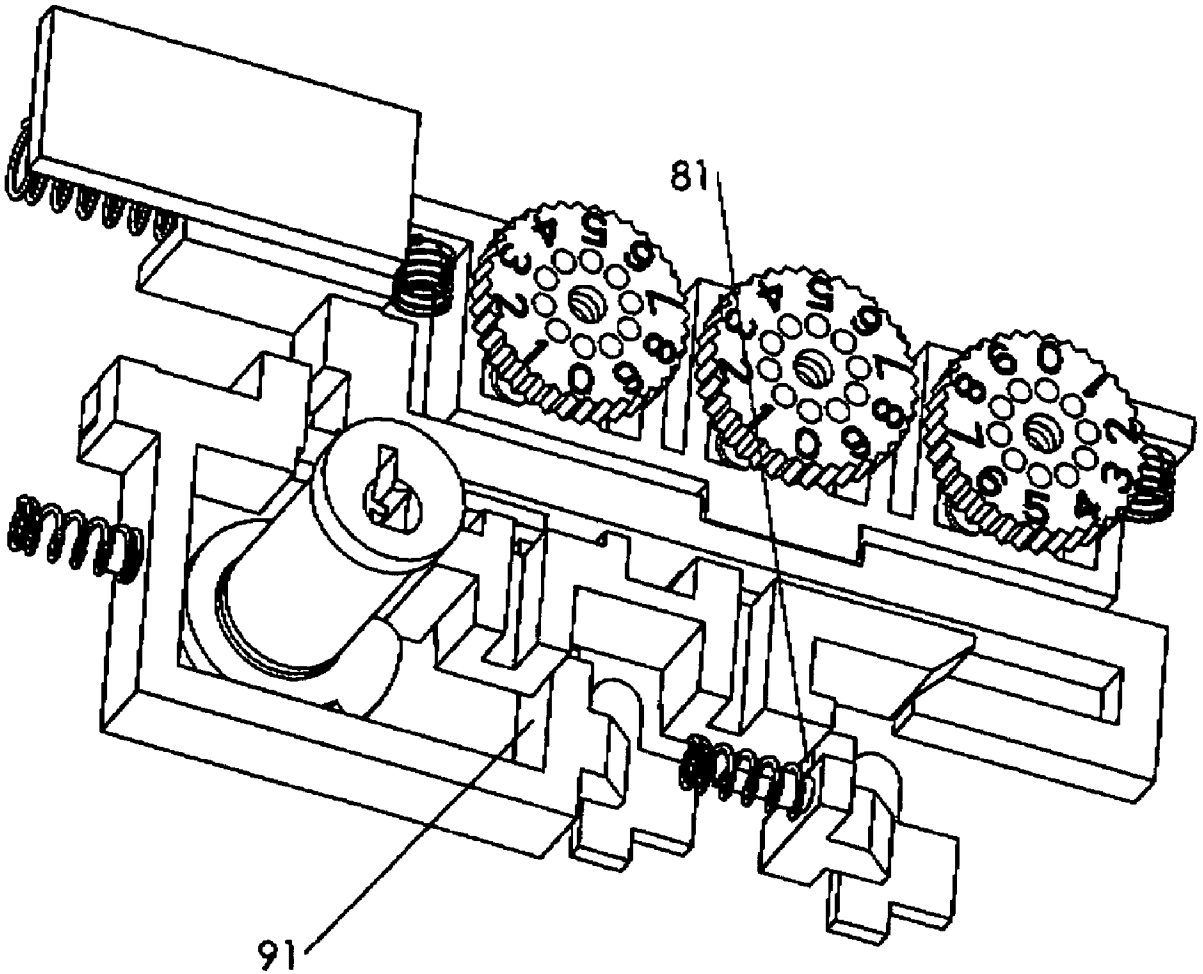
Figure 8:
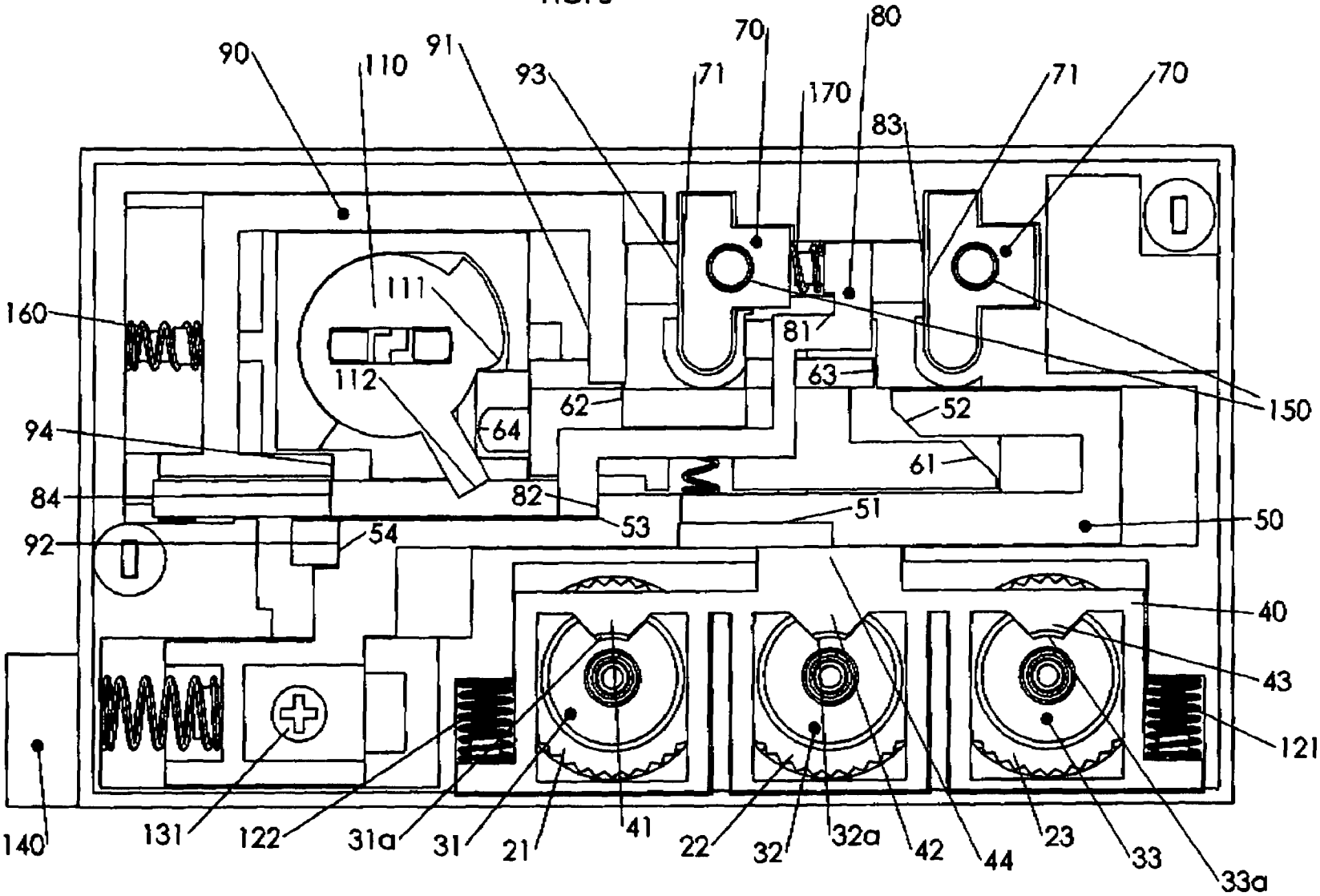
FIG. 8 is a bottom plan view of the dual mode, zipper pull locking system of FIG. 1 with a bottom cover removed and shown in the unlocked position by employing the combination controlled locking section.
Figure 9:
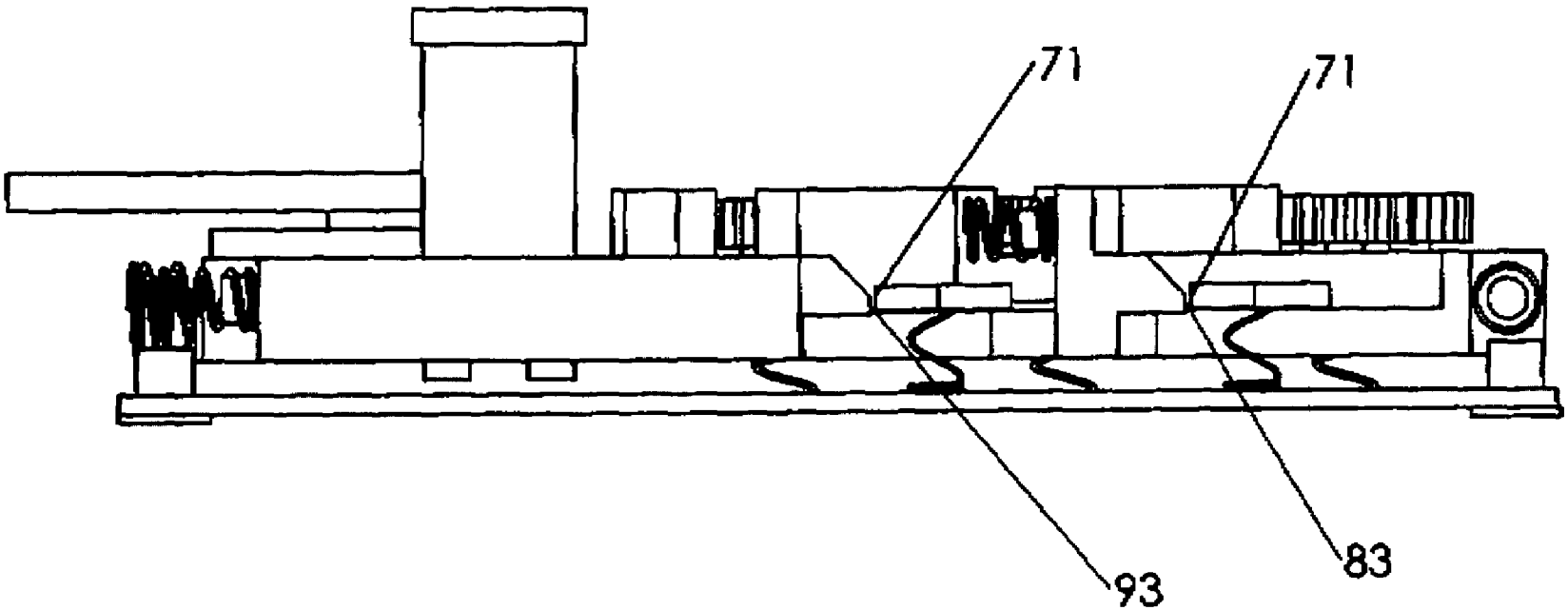
FIG. 9 is a side elevation view of the dual mode, zipper pull locking system of FIG. 8 with the housing removed.
Figure 10:
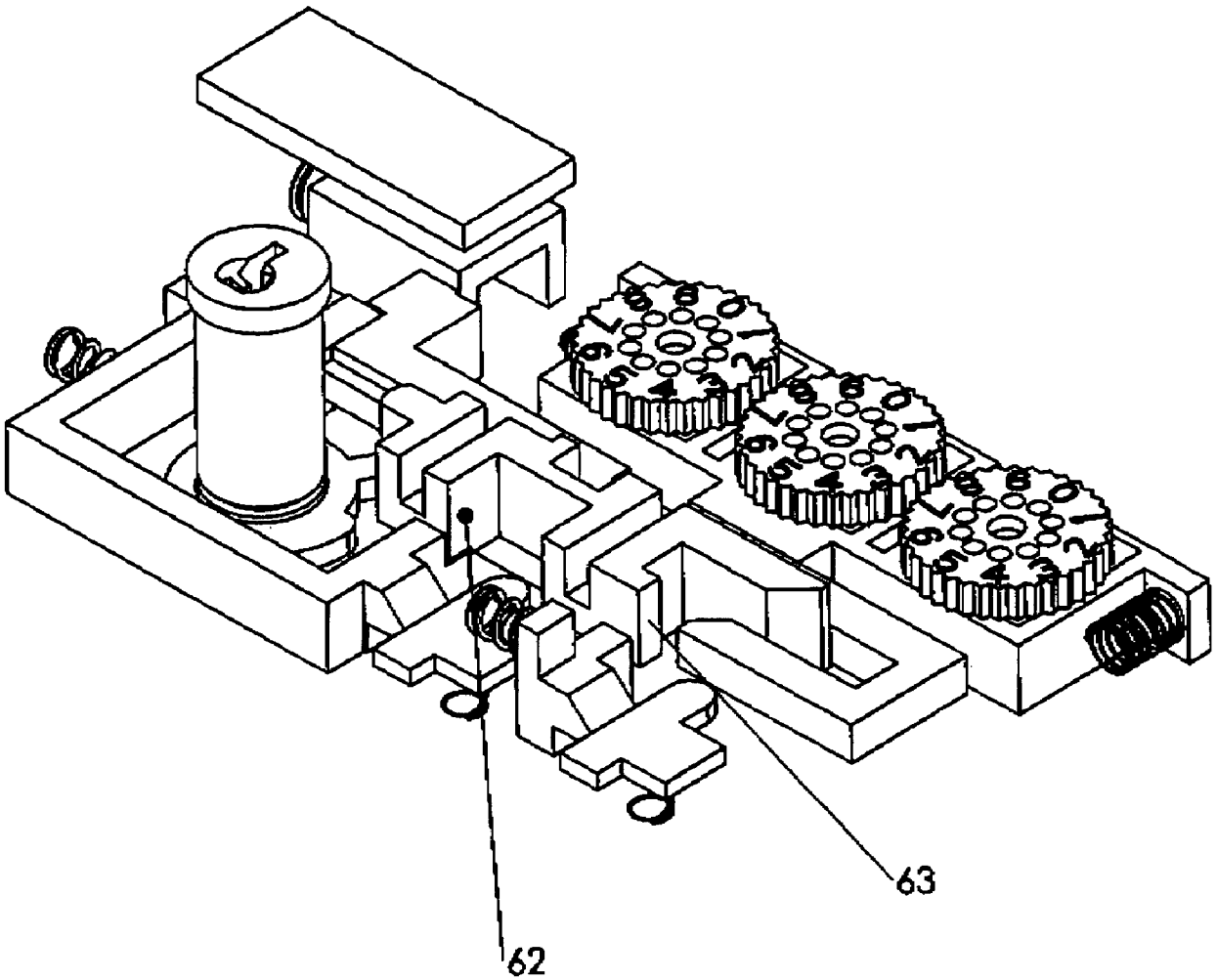
FIGS. 10 and 11 are front perspective views of the dual mode, zipper pull locking system of the present invention shown with the housing removed.
Figure 11:
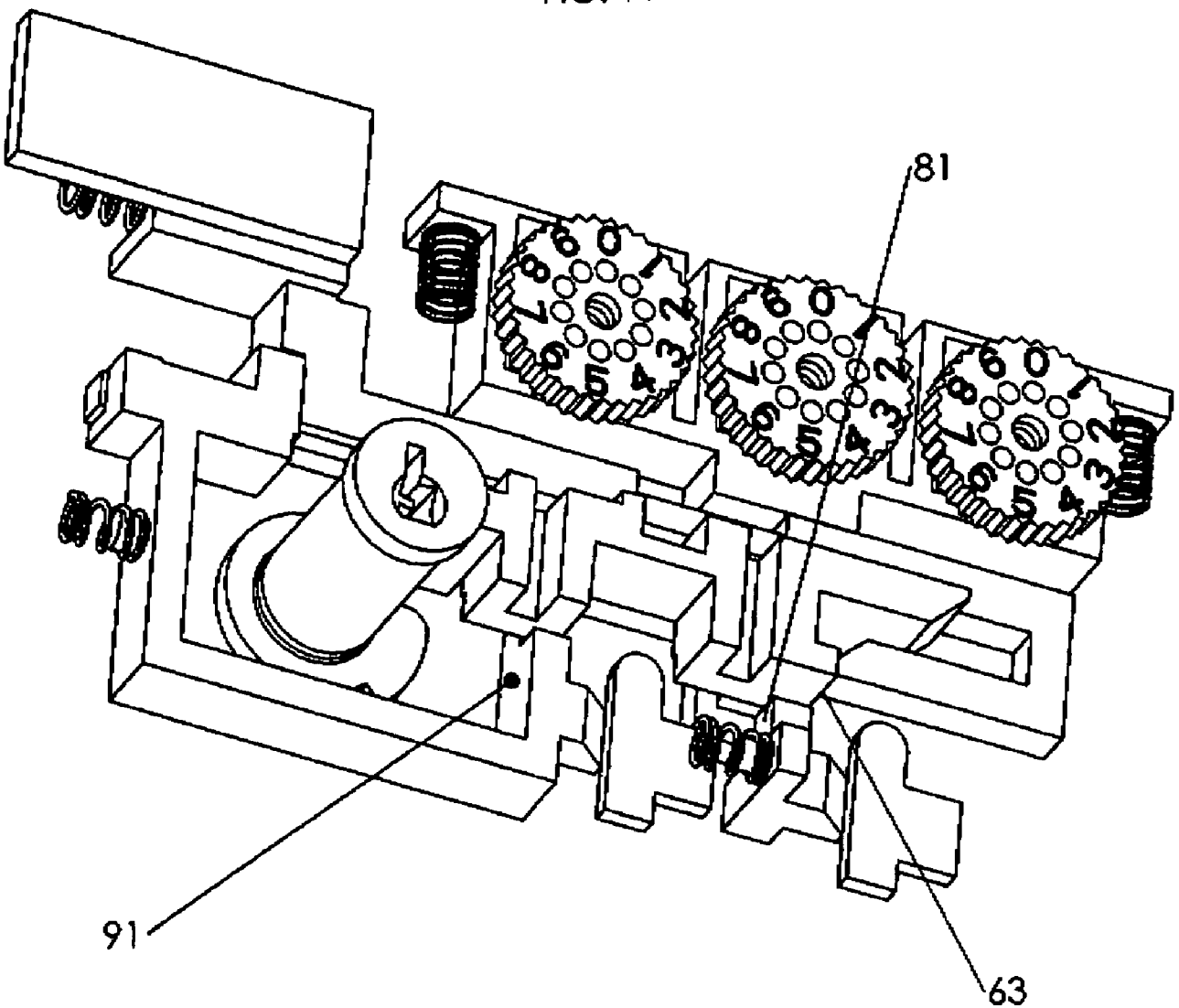
Figure 12:
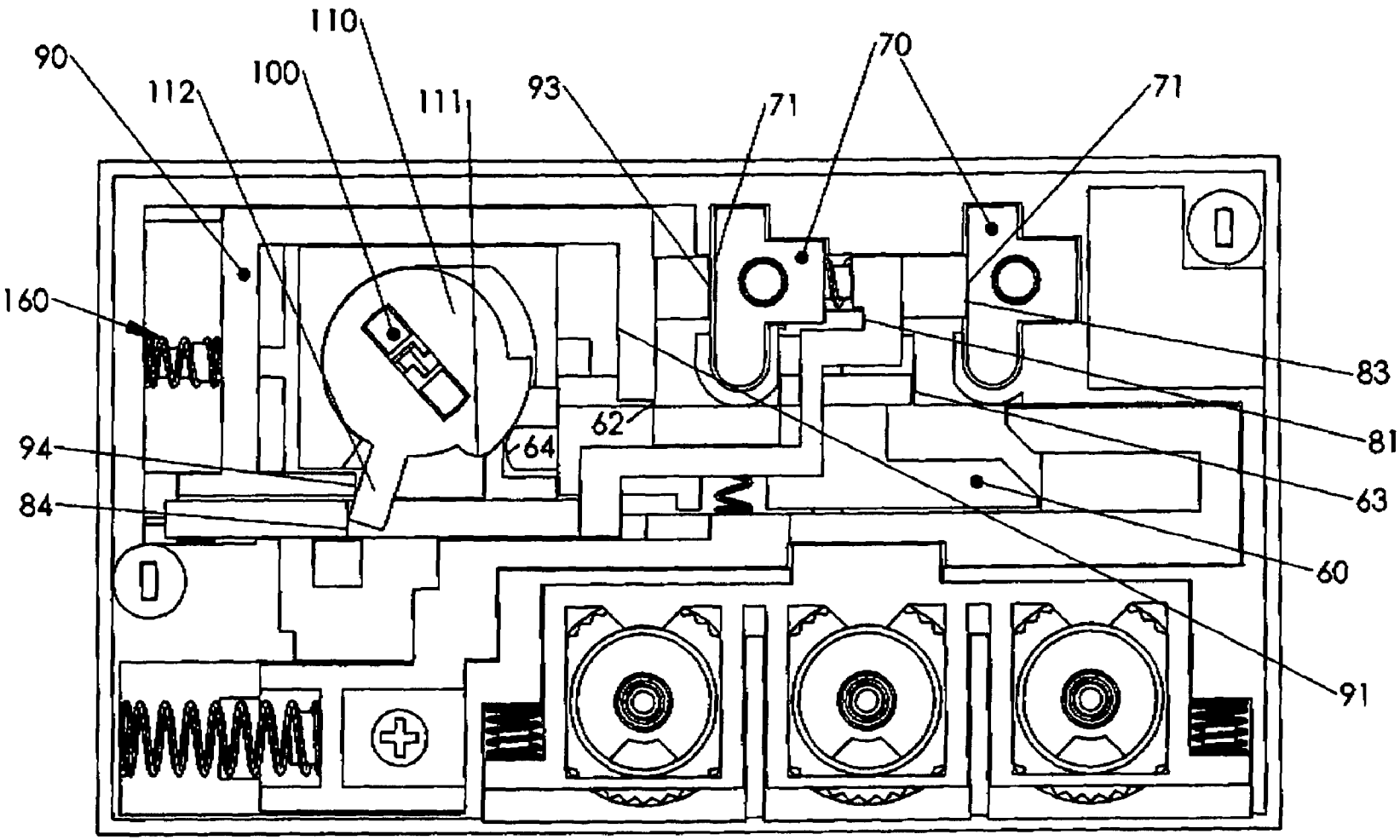
FIG. 12 is a bottom plan view of the dual mode, zipper pull locking system of the present invention with the bottom cover removed and shown in the unlocked position by employing the key controlled locking section.
Figure 13:
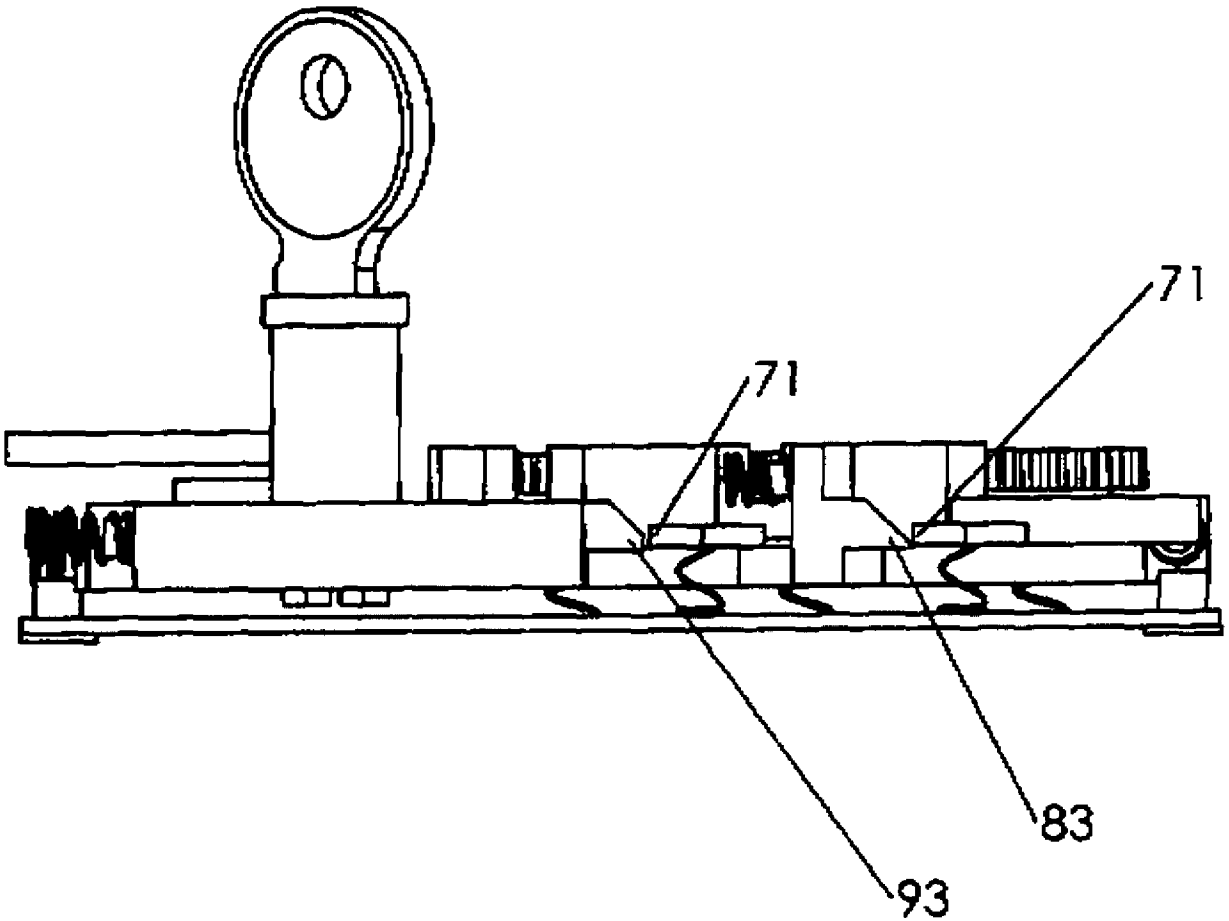
FIG. 13 is a side elevation view of the dual mode, zipper pull locking system of FIG. 12 shown with the housing removed.
Figure 14:
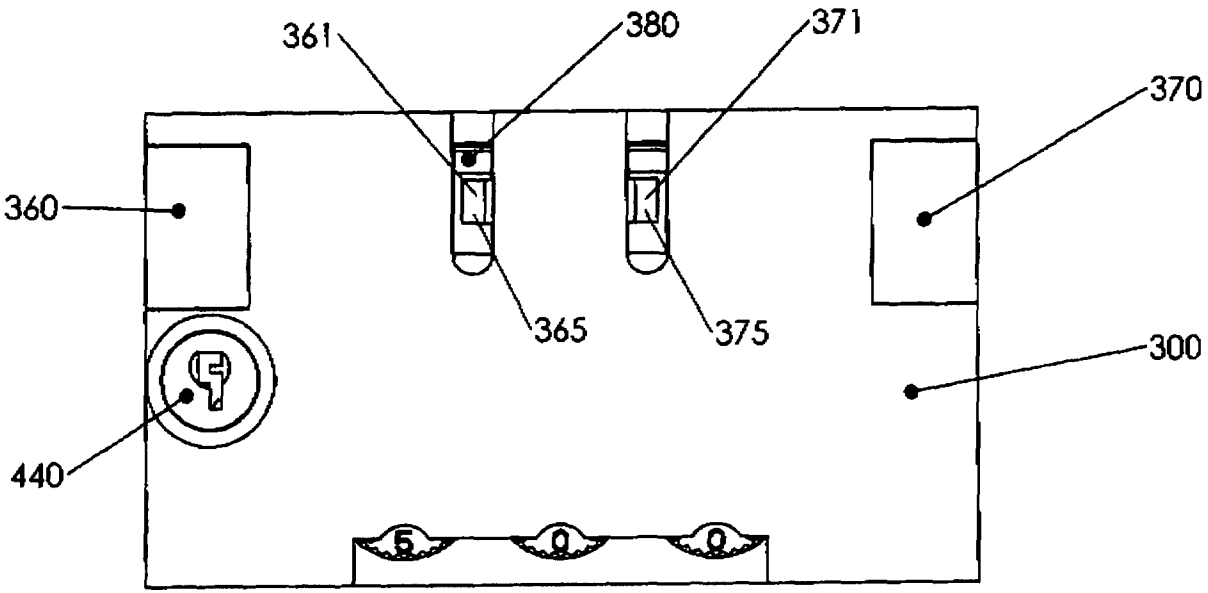
FIG. 14 is a top plan view of a second preferred embodiment of the dual mode, zipper pull locking system of the present invention.
Figure 15:
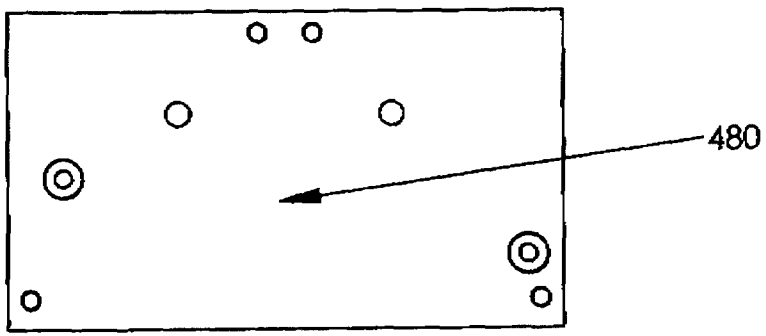
FIG. 15 is a bottom plan view of the dual mode, zipper pull locking system of FIG. 14.

By referring to FIGS. 1-40B, along with the following detailed discussion, the construction and operation of three alternate preferred embodiments of dual mode, zipper pull locking system 10 of the present invention can best be understood. However, numerous variations may be made in the present invention without departing from the scope of this invention. Consequently, it is to be understood that the following detailed disclosure of the embodiments shown in FIGS. 1-40B are provided for exemplary purposes only and are not intended as a limitation of the present invention.

In FIGS. 1-36, three alternate preferred embodiments of dual mode, zipper pull locking system 10 of the present invention are depicted, with each embodiment using a minimum number of principal components, thereby achieving a dual-mode locking system while also substantially reducing the complexity found in most prior art locking systems. In this way, the invention provides highly effective, commercially desirable constructions which are capable of being produced at competitive costs, while also providing the unique attributes of the present invention and all of the locking and theft deterrent features typically incorporated in prior art locking systems.

As a fully detailed herein, the embodiments of the present invention incorporate uniquely constructed, interconnected control plates and cooperating components which are employed for controlling the movement of locking latches which securely engage the zipper pulls of any product on which the locking system of the present invention is employed. By employing the constructions detailed herein, a highly effective, easily produced, dual mode locking system is realized which is capable of providing all of the attributes desired in a highly effective, competitively priced, zipper pull locking system.

In the embodiments of the present invention, one of the principal components forming zipper pull locking system 10 is housing 12 which incorporates zipper pull receiving and holding zones 14 and 15. As is well known in the art, in the typical construction of any zipper employed on suitcases, briefcases, and other similar products, two separate and independent zipper pulls are employed for allowing the zipper to be opened and closed from a wide variety of alternate positions. Furthermore, each of the zipper pulls incorporates a tab member, typically formed from plastic or metal, with an enlarged opening or aperture formed therein. By employing the aperture formed in each zipper pull, the locking system of the present invention is able to securely engaged each of the zipper pulls in the separate retaining zones, maintaining the zipper pulls completely locked and secured to housing 12 of locking system 10.

Furthermore, each of the three alternate embodiments of the present invention incorporate a combination controlled locking section 17 and a key controlled locking section 18, both of which are contained in housing 12. In addition, as is fully detailed in the following disclosure, key controlled locking section 18 and combination controlled locking section 17 are constructed in a manner which independently activates the cooperating locking plates and sliders mounted in housing 12 for causing the associated zipper pull latching members to move in a direction which releases the zipper pulls secured thereto. In this way, the embodiments of the present invention provide for the secure locking and controlled release of each of the two zipper pulls, when desired, by the activation of either the combination controlled locking section or the key controlled locking section.

In the first preferred embodiment of the present invention, depicted in FIGS. 1-13, zipper pull locking system 10 incorporates, in addition to the components detailed above, zipper pull locking latch members 80 and 90. As depicted and detailed herein, zipper pull locking latch member 80 is constructed for independently moving relative to zipper pull receiving zone 14, while the zipper pull locking latch member 90 is constructed for independently moving relative to zipper pull receiving zone 15. In this regard, both zipper pull locking latch members 80 and 90 are constructed for lateral movement into and out of the area defined by receiving zones 14 and 15, for enabling each zipper pull locking latch member 80 and 90 to securely engage the aperture formed in the associated zipper pull for securely retaining the zipper pull to housing 12, while also being disengaged therefrom when release of the zipper pull is desired.

As clearly depicted throughout the Figures, zipper pull locking latch members 80 and 90 each comprise elongated, longitudinally extending integrated sections which are mounted in housing 12 for enabling latch members 80 and 90 to move in a desired, controlled direction. In this regard, zipper pull engaging elements 85 and 95 are formed as a component of latch members 80 and 90 and represent the component of latch members 80 and 90 which are inserted directly into the apertures formed in the zipper pulls for controlling the locked engagement and release of the zipper pulls when desired. The remaining construction of latch members 80 and 90 are employed for providing the desired movement of zipper pull engaging elements 85 and 95.

As more fully detailed below, zipper pull engaging elements 85 and 95 are automatically advanced into locked engagement with the apertures of each zipper pull whenever the zipper pull is inserted into zipper pull receiving zones of 14 and 15. This automatic locking engagement is achieved by the biasing forces provided by spring members 160 and 170 acting on latch members 80 and 90.

In order to achieve the desired controlled movement of zipper pull locking latch members 80 and 90, locking system 10 incorporates control plate 60 as a principal element for achieving the desired movement. As depicted, and more fully detailed below, control plate 60 effectively blocks any lateral movement of zipper pull locking latch members 80 and 90 in the locked position, while enabling latch members 80 and 90 to move laterally whenever control plate 60 has been moved out of blocking relationship therewith.

In this regard, whenever key controlled locking section 18 is employed, flange 111 of plate 110 of cylinder 100 arcuately pivots into direct contact with a portion of control plate 60, causing control plate 60 to move out of locking engagement with latch members 80 and 90 for enabling latch members 80 and 90 to move within the housing 12. In addition, once this locking disengagement has been achieved, radially extending arm 112 of plate 110 of cylinder 100 directly contacts latch member 80 causing both latch members 80 and 90 to move within housing 12, resulting in both zipper pull engaging elements 85 and 95 being moved out of engagement with their associated zipper pulls. In this way, the zipper pulls are immediately released in response to the arcuate pivoting movement of cylinder 100.

In addition, as is more fully detailed below, whenever combination controlled locking section 17 is employed, slider assembly 50 is moved for directly controlling the movement of control plate 60 for releasing the blocking of latch members 80 and 90. In addition, when control plate 60 has been moved out of blocking relationship with latch members 80 and 90, the continued movement of slider assembly 50 causes direct contact with latch members 80 and 90, for moving latch members 80 and 90 in housing 12, effectively releasing zipper pull engaging elements 85 and 95 from locked engagement with the associated zipper pulls. In this way, the zipper pulls are immediately released in response to the pre-determined combination being entered in combination controlled locking section 17.

As is evident from the foregoing detailed discussion, by employing either combination controlled locking section 17 or key controlled locking section 18, zipper pull engaging elements 85 and 95 of locking latch members 80 and 90 are controllably released, when desired, for enabling any zipper pulls affixed thereto to be disengaged from locking system 10, enabling the suitcase, briefcase, or other product to be opened. In addition, as is more fully detailed below, whenever desired, a user is able to insert the zipper pulls of the desired product into locking system 10 for securely engaging the zipper pulls in system 10 for achieving the desired locked interengagement therewith.

In the preferred construction of this embodiment of the present invention, combination controlled locking section 17 comprises a plurality of indicia bearing rotatable dials 21, 22, and 23 for setting and inputting a desired combination for locking and unlocking zipper pull locking system 10. In order to enable the user to readily display any desired combination, housing 12 preferably comprises a display area formed therein for enabling the indicia formed on the rotatable dials to be readily visible. In general, the construction of combination controlled locking section 17 is similar to the construction detailed in U.S. Pat. No. 6,408,660, the pertinent portions of which are hereby incorporated by reference.

As shown, rotatable dials 21, 22, and 23 are mounted in cooperating association with one clutch ring 31, 32, or 33. Furthermore, in order to maintain clutch rings 31, 32, and 33 in frictional engagement with dials 21, 22, and 23, a spring member is coaxially associated with each assembly to provide the required biasing force for maintaining each clutch ring in continuous frictional engagement with its associated dial. In this way, rotational movement of dials 21, 22, and 23 about their central axis causes clutch rings 31, 32, and 33 to rotationally move therewith.

Although the detailed construction and operation of dials 21, 22, and 23, and cooperating clutch rings 31, 32, and 33 are fully detailed below and in U.S. Pat. No. 6,408,660, one structural feature which is important to note is the incorporation of a slot 31*a*, 32*a*, and 33*a* in each clutch ring 31, 32, and 33. As detailed herein, each slot 31*a*, 32*a*, and 33*a* of each clutch ring 31, 32, and 33 controls the locking and unlocking of system 10 in combination with the rotation of dials 21, 22, and 23.

In order to provide the desired locking and controlled release of the zipper pulls from zipper pull engaging elements 85 and 95 whenever the combination controlled locking section 17 is employed, combination controlled locking section 17 incorporates locking plate 40. In its preferred construction, locking plate 40 incorporates finger members 41, 42, and 43, each of which are aligned with one of the slots 31*a*, 32*a*, and 33*a* formed in clutch rings 31, 32, and 33. In addition, locking plate 40 is continuously biased by spring members 121 and 122 into engagement with clutch rings 31, 32, and 33, thereby causing locking plate 40 to automatically move into engagement with the clutch rings whenever slots 31*a*, 32*a*, and 33*a* are aligned with finger members 41, 42, and 43.

When all three slots are placed in aligned relationship with all three finger members, which is achieved only when the desired preset combination has been input on rotatable dials 21, 22, and 23, locking plate 40 automatically moves due to the spring forces imposed thereon. However, whenever an incorrect combination is entered on dials 21, 22, and 23, one or more of the slots 31*a*, 32*a*, and 33*a* of the associated clutch rings 31, 32, and 33 will be placed in a position which is not aligned with one of the associated fingers 41, 42, and 43 of locking plate 40. As a result, locking plate 40 will be incapable of movement, resulting in locking system 10 being maintained in the locked position.

Once locking plate 40 has been moved in housing 12, as detailed above, flange 44 of locking plate 40 is moved out of blocking engagement with gap or cutout zone 51 of the slider assembly 50. As a result, slider assembly 50 is released and is able to be longitudinally moved in housing 12.

In the preferred construction, as depicted in the Figures, locking system 10 incorporates pushbutton 140 which is secured to slider assembly 50 by screw 131. As a result, once locking plate 40 has been moved, the user is able to employ pushbutton 140 to cause slider assembly 50 to move longitudinally within housing 12. As slider assembly 50 is longitudinally moved, sloping edge surface 52 of slider assembly 50 contacts sloping edge surface 61 of control plate 60. The engagement of these two sloping surfaces causes control plate 60 to move in a direction towards locking plate 40 and dials 21, 22, and 23, causing blocking edges 62 and 63 of control plate 60 to become disengaged from sidewalls 91 and 81 of locking latch members 90 and 80.

In addition, as slider assembly 50 continues to move longitudinally within housing 12, after contacting and moving control plate 60, edges 53 and 54 of slider assembly 50 contact surfaces 92 and 82 of locking latch members 90 and 80. In the preferred construction, edge 53 is constructed to be spaced away from surface 82 by a distance 55, while edge 54 is spaced away from surface 92 by a distance 56. As a result of this construction, a built-in delay zone is created which allows sloping surface 52 of slider assembly 50 to contact control plate 60 and achieve the required movement of control plate 60 prior to any contact of edges 53 and 54 with locking latch members 80 and 90.

As a result, the blocking engagement of control plate 60 with locking latch members 80 and 90 is removed prior to any contact of slider assembly 50 with latch members 80 and 90. In this way, latch members 80 and 90 are able to be moved longitudinally in housing 12, against the biasing spring forces of spring members 160 and 170 in response to the engagement with slider assembly 50. As a result, zipper pull engaging elements 85 and 95 are removed from the zipper pulls associated therewith, effectively releasing the zipper from locked engagement in housing 12.

In the preferred construction, zipper pull locking system 10 also incorporates two blocking plates 70, each of which are associated with one of the locking latch members 80 and 90, and the zipper pull engaging elements 85 and 95 thereof. In addition, as depicted in the drawings, each blocking plate 70 is associated with a spring 150 which continuously biases blocking plate 70 in a direction towards zipper pull engaging element 85 and 95. As a result, whenever locking latch members 80 and 90 have been moved into the released position, causing zipper pull engaging elements 85 and 95 to be withdrawn from the zipper pull associated therewith, blocking plates 70 cause the zipper pull to pop up and be automatically released therefrom.

In addition, each blocking plate 70 is moved upwardly, with the side edges thereof moving between housing 12 and the leading edge of zipper pull engaging elements 85 and 95, preventing locking latch members 80 and 90 from returning to their original position once the forces are removed from pushbutton 140. In this regard, as shown, side edges 71 of blocking plates 70 contact surfaces 83 and 93 of zipper pull engaging elements 85 and 95 of locking latch members 80 and 90, preventing any movement of latch members 80 and 90.

As a result of this construction, locking latch members 80 and 90 are only able to move back to their locking position when a zipper pull is inserted into zipper receiving zones 14 and 15 and blocking plates and 70 are moved downwardly, causing side edges 71 of blocking plates 70 to be moved out of engagement with surfaces 93 and 83 of locking latch members 90 and 80. Once this blocking engagement is removed, locking latch members 80 and 90 automatically move back into engagement with the zipper pulls, due to the biasing forces being exerted by springs 160 and 170.

In addition, prior to inserting zipper pulls into locking system 10, any desired combination can be set on dials 21, 22, and 23. By holding push button 140 in the open position, as detailed above, locking plate 40 engaged with the clutch rings, the user can turn dials 21, 22, and 23 for setting any desired indicia as the combination.

In addition to opening lock system 10 by employing combination controlled section 17, lock system 10 may also be opened by employing key controlled section 18. By referring to FIGS. 1-13, along with the following detailed discussion, the construction and operation of system 10 for the locking and unlocking thereof by employing key controlled section 18 can best be understood. Furthermore, it should also be understood that alternate constructions of key controlled locking section 18 can be employed without departing from the scope of this invention. However, for exemplary purposes only, the preferred construction is fully detailed herein.

In this construction, key controlled locking section 18 of housing 12 of lock system 10 incorporates cylinder 100 which is mounted within a receiving cavity formed in housing 12 and constructed for enabling cylinder 100 to arcuately pivot whenever the correct key is inserted into the receiving slot formed in cylinder 100. In this regard, cylinder 100 incorporates a tumbler construction which is aligned in a precisely desired configuration whenever the matching key is inserted into the receiving slot thereof. Once inserted, the pivoting movement of cylinder 100 is attained.

As shown in the Figures, cylinder 100 incorporates cam plate 110 mounted to the distal end thereof and constructed for arcuate pivoting movement simultaneously with the arcuate movement of cylinder 100 in response to the insertion and use of the correct key member. As a result, whenever the correct key has been inserted into the receiving slot formed in cylinder 100, and the key is employed to pivot cylinder 100, cam plate 110 simultaneously pivots therewith.

As depicted, in the preferred construction, cam plate 110 incorporates a radially extending flange portion 111 and a radially extended arm member 112. Upon insertion of the appropriate key into the cylinder 100, cylinder 100 is rotated by employing the key which simultaneously causes cam plate 110 to rotate therewith. This rotation causes flange portion 111 to pivot and contact finger 64 of control plate 60. In addition, the continued movement of cylinder 100 forces finger 64 to move therewith, causing control plate 60 to move in housing 12 towards dials 21, 22 and 23. This movement removes edges 62 and 63 from blocking engagement with sidewalls 91 and 81 of locking latch members 80 and 90.

As cylinder 100 continues to rotate due to the continued rotation of the key therein, arm 112 of cam plate 110 contacts lips 94 and 84 of locking latch members 90 and 80. This contact and continued movement causes locking latch members 90 and 80 to move within housing 12, and results in the withdrawal of zipper engaging elements 95 and 85 from the zipper pulls, resulting in the zipper pulls popping free and blocking plates 70 moving into engagement with elements 95 and 85.

In the preferred construction of this embodiment, the key can be removed from cylinder 100 when system 10 is in the unlocked mode. Although most prior art padlock constructions prevent the removal of the key in the unlocked mode, the present invention allows the key removal, thereby satisfying the new rules of the security agencies.

In FIGS. 14-23, the second preferred embodiment of zipper pull locking system 10 of the present invention is depicted. By referring to these Figures, along with the following detailed discussion, the construction and operation of this second preferred embodiment can best be understood. Furthermore, as is evident from this disclosure, a minimum number of principal components are employed, thereby achieving zipper pull locking system which also substantially reduces the complexity found in most prior art systems. In this way, the invention provides a highly effective, commercially desirable construction which is capable of being produced at competitive costs, while also providing the unique attributes of the present invention and all of the locking and theft deterrent features typically incorporated in prior locking systems.

As discussed above, the embodiments of the present invention incorporate uniquely constructed, interconnected control plates and cooperating components which are employed for controlling the movement of locking latches which securely engage the zipper pulls of any product on which the locking system of the present invention is employed. By employing one of the constructions detailed herein, a highly effective, easily produced, dual mode locking system is realized which is capable of providing all of the attributes desired in a highly effective, competitively priced, zipper pull locking system.

In this embodiment of the present invention, one of the principal components forming zipper pull locking system 10 is housing 300 which incorporates zipper pull receiving and holding zones 14 and 15. As is well known in the art and discussed above, in the typical construction of any zipper employed on suitcases, briefcases, and other similar products, two separate and independent zipper pulls are employed for allowing the zipper to be opened and closed from a wide variety of alternate positions. Furthermore, each of the zipper pulls incorporates a tab member, typically formed from plastic or metal, with an enlarged opening or aperture formed therein. By employing the aperture formed in each zipper pull, the locking system of the present invention is able to securely engage each of the zipper pulls in the separate retaining zones, maintaining the zipper pulls completely locked and secured to housing 300 of locking system 10.

Furthermore, this embodiment of the present invention also incorporates combination controlled locking section 17 and key controlled locking section 18, both of which are contained in housing 300. In addition, as is fully detailed in the following disclosure, key controlled locking section 18 and combination controlled locking section 17 are constructed in a manner which independently activates the cooperating locking plates and sliders mounted in housing 300 for causing the associated zipper pull latching members to move in a direction which releases the zipper pulls secured thereto. In this way, all of the embodiments of the present invention provide for the secure locking and controlled release of each of the two zipper pulls, when desired, by the activation of either the combination controlled locking section or the key controlled locking section. Furthermore, in this second preferred embodiment, the zipper pulls can be separately controlled, thereby releasing one zipper pull while not releasing the other.

In the second preferred embodiment of the present invention, as depicted in FIGS. 14-23, zipper pull locking system 10 incorporates, in addition to the components detailed above, zipper pull locking latch members 360 and 370. As depicted and detailed herein, zipper pull locking latch member 360 is constructed for independently moving relative to zipper pull receiving zone 14, while the zipper pull locking latch member 370 is constructed for independently moving relative to zipper pull receiving zone 15. In this regard, both zipper pull locking latch members 360 and 370 are constructed for lateral movement into and out of the area defined by receiving zones 14 and 15, for enabling each zipper pull locking latch member 360 and 370 to securely engage the aperture formed in the associated zipper pull for securely retaining the zipper pull to housing 300, while also being separately disengaged therefrom when the release of one of the zipper pulls is desired.

As clearly depicted throughout the Figures, zipper pull locking latch members 360 and 370 each comprise elongated, longitudinally extending flat plates which are mounted in housing 300 for enabling latch members 360 and 370 to move in a opposite directions. In this regard, zipper pull engaging elements 365 and 375 are formed as a component of latch members 360 and 370 and represent the component of latch members 360 and 370 which are inserted directly into the apertures formed in the zipper pulls for controlling the locked engagement and release of the zipper pulls when desired. The remaining construction of latch members 360 and 370 are employed for providing the desired movement of zipper pull engaging elements 365 and 375.

As is it more fully detailed below, zipper pull engaging elements 365 and 375 are automatically advanced into locked engagement with the apertures of each zipper pull whenever the zipper pull is inserted into zipper pull receiving zones of 14 and 15. This automatic locking engagement is achieved by the biasing forces provided by spring members 420 and 430 acting on latch members 360 and 370.

In order to achieve the desired controlled movement of zipper pull locking latch members 360 and 370, locking system 10 incorporates control plate 340 in combination with blocking element 350 as the principal elements for achieving the desired movement. As depicted, and more fully detailed below, blocking element 350 effectively blocks any lateral movement of zipper pull locking latch members 360 and 370 in the locked position, while enabling latch members 360 and 370 moved laterally inwardly by the user whenever blocking plate 350 has been moved out of blocking relationship therewith.

In this regard, whenever key controlled locking section 18 is employed, arm 391 of cam plate 390 of cylinder 440 arcuately pivots into direct contact with a portion of control plate 340, causing control plate 340 to move out longitudinally of blocking engagement with blocking element 350. Once control plate 340 has moved a sufficient distance, blocking element 350 automatically moves into a cavity formed in plate 340 due to spring 400, enabling latch members 360 and 370 to be manually moved by the user within housing 300. In addition, once the user has moved either or both latch members 360 and 370 into housing 300, both zipper pull engaging elements 365 and 375 are moved out of engagement with their associated zipper pulls. In this way, the zipper pulls are immediately released.

In addition, as is more fully detailed below, whenever combination controlled locking section 17 is employed, locking plate 330 is moved for directly controlling the movement of control plate 340 for releasing blocking element 350 and enabling latch members 360 and 370 to be movable. When control plate 340 has been moved out of blocking relationship with blocking element 350, blocking element 350 automatically moves into a receiving zone of plate 340, effectively releasing latch members 360 and 370, and allowing the latch members to be manually moved by the user, effectively releasing zipper pull engaging elements 365 and 370 from locked engagement with the associated zipper pulls. In this way, the zipper pulls are immediately released in response to the pre-determined combination being entered in combination controlled locking section 17.

As is evident from the foregoing detailed discussion, by employing either combination controlled locking section 17 or key controlled locking section 18, zipper pull engaging elements 365 and 375 of locking latch members 360 and 370 are controllably released, when desired, for enabling any zipper pulls affixed thereto to be disengaged from locking system 10, enabling the suitcase, briefcase, or other product to be opened. In addition, as is more fully detailed below, whenever desired, a user is able to insert the zipper pulls of the desired product into locking system 10 for securely engaging the zipper pulls in system 10 for achieving the desired locked interengagement therewith.

In the preferred construction of this embodiment of the present invention, combination controlled locking section 17 comprises a plurality of indicia bearing rotatable dials 321, 322, and 323 for setting and inputting a desired combination for locking and unlocking zipper pull locking system 10. In order to enable the user to readily display any desired combination, housing 300 preferably comprises a display area formed therein for enabling the indicia formed on the rotatable dials to be readily visible. In general, the construction of combination controlled locking section 17 is similar to the construction detailed in U.S. Pat. No. 6,408,660, the pertinent portions of which are hereby incorporated by reference.

As shown, rotatable dials 311, 312, and 313 are mounted in cooperating association with one clutch ring 321, 322, or 323. Furthermore, in order to maintain clutch rings 321, 322, and 323 in frictional engagement with dials 311, 312, and 313, a spring member is co-axially associated with each assembly to provide the required biasing force for maintaining each clutch ring in continuous frictional engagement with its associated dial. In this way, rotational movement of dials 311, 312, and 313 about their central axis causes clutch rings 321, 322, and 323 to rotationally move therewith.

Although the detailed construction and operation of dials 311, 312, and 313, and cooperating clutch rings 321, 322, and 323 are fully detailed below and in U.S. Pat. No. 6,408,660, one structural feature which is important to note is the incorporation of a slot 321*a*, 322*a*, and 323*a* in each clutch ring 321, 322, and 323. As detailed herein, each slot 321*a*, 322*a*, and 323*a* of each clutch ring 321, 322, and 323 controls the locking and unlocking of system 10 in combination with the rotation of dials 311, 312, and 313.

In order to provide the desired locking and controlled release of the zipper pulls from zipper pull engaging elements 365 and 375 whenever the combination controlled locking section 17 is employed, combination controlled locking section 17 incorporates locking plate 330. In its preferred construction, locking plate 330 incorporates finger members 331, 332, and 333, each of which are aligned with one of the slots 321*a*, 322*a*, and 323*a* formed in clutch rings 321, 322, and 323. In addition, locking plate 330 is continuously biased by spring member 410 into engagement with clutch rings 321, 322, and 323, thereby causing locking plate 330 to automatically move into engagement with the clutch rings whenever slots 321*a*, 322*a*, and 323*a* are aligned with finger members 331, 332, and 333.

When all three slots are placed in aligned relationship with all three finger members, which is achieved only when the desired preset combination has been input on rotatable dials 311, 312, and 313, locking plate 330 automatically moves due to the spring forces imposed thereon. However, whenever an incorrect combination is entered on dials 311, 312, and 313, one or more of the slots 321*a*, 322*a*, and 323*a* of the associated clutch rings 321, 322, and 323 will be placed in a position which is not aligned with one of the associated fingers 331, 332, and 333 of locking plate 330. As a result, locking plate 330 will be incapable of movement, resulting in locking system 10 being maintained in the locked position.

Figure 16:
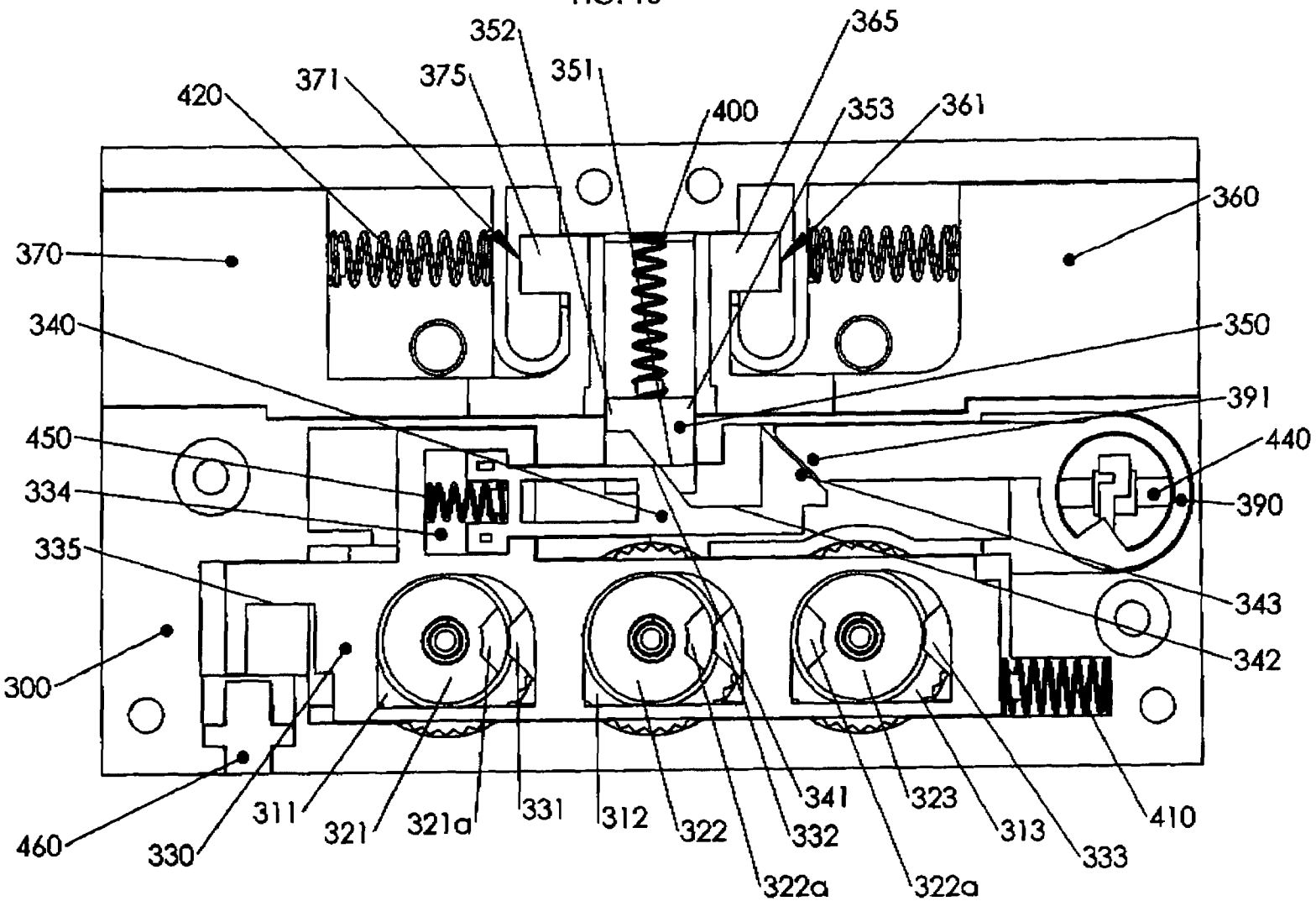
FIGS. 16 and 17 are bottom plan views of the dual mode, zipper pull locking system of FIG. 14 shown with the bottom cover removed and in the locked position.
Figure 17:
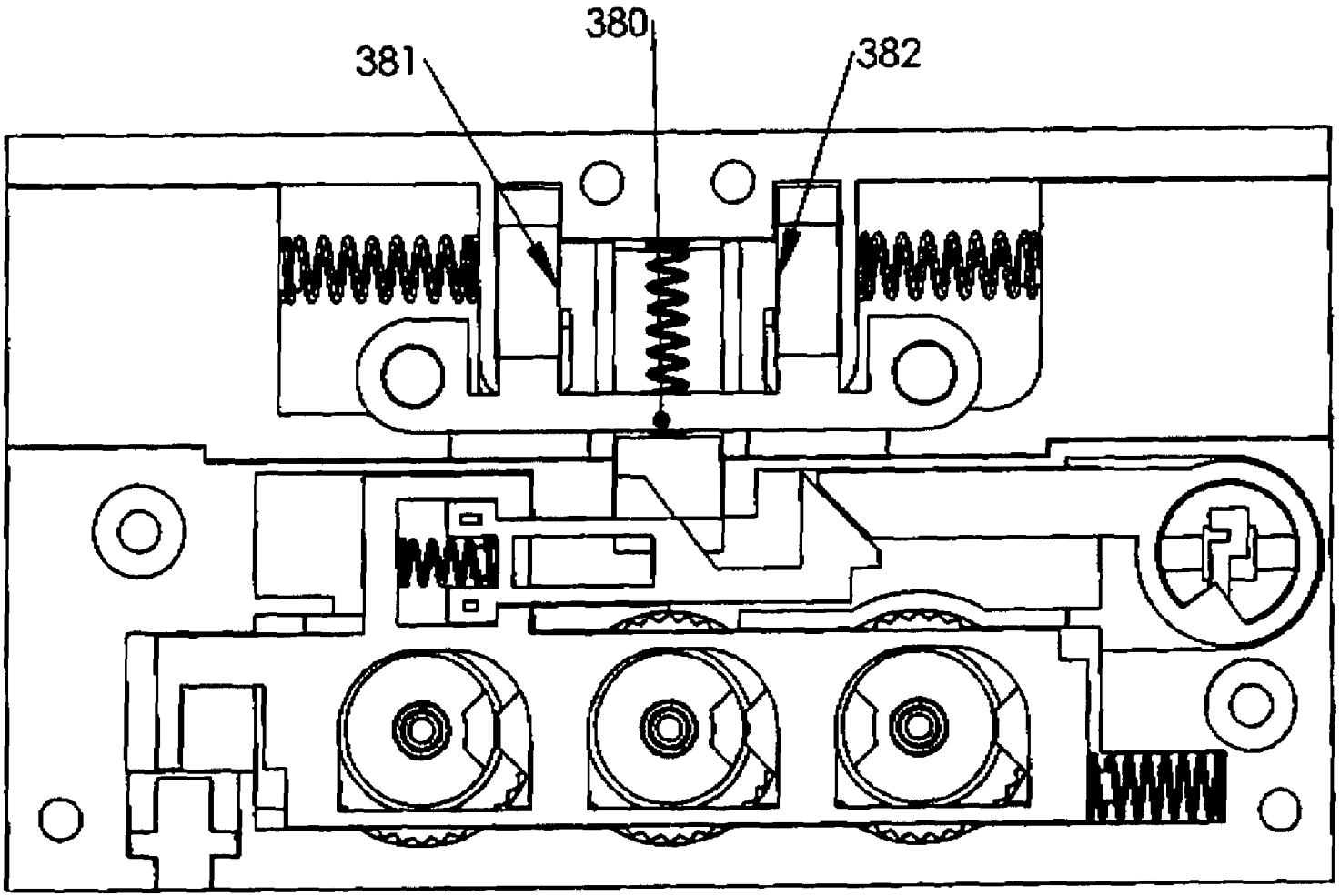
Figure 18:
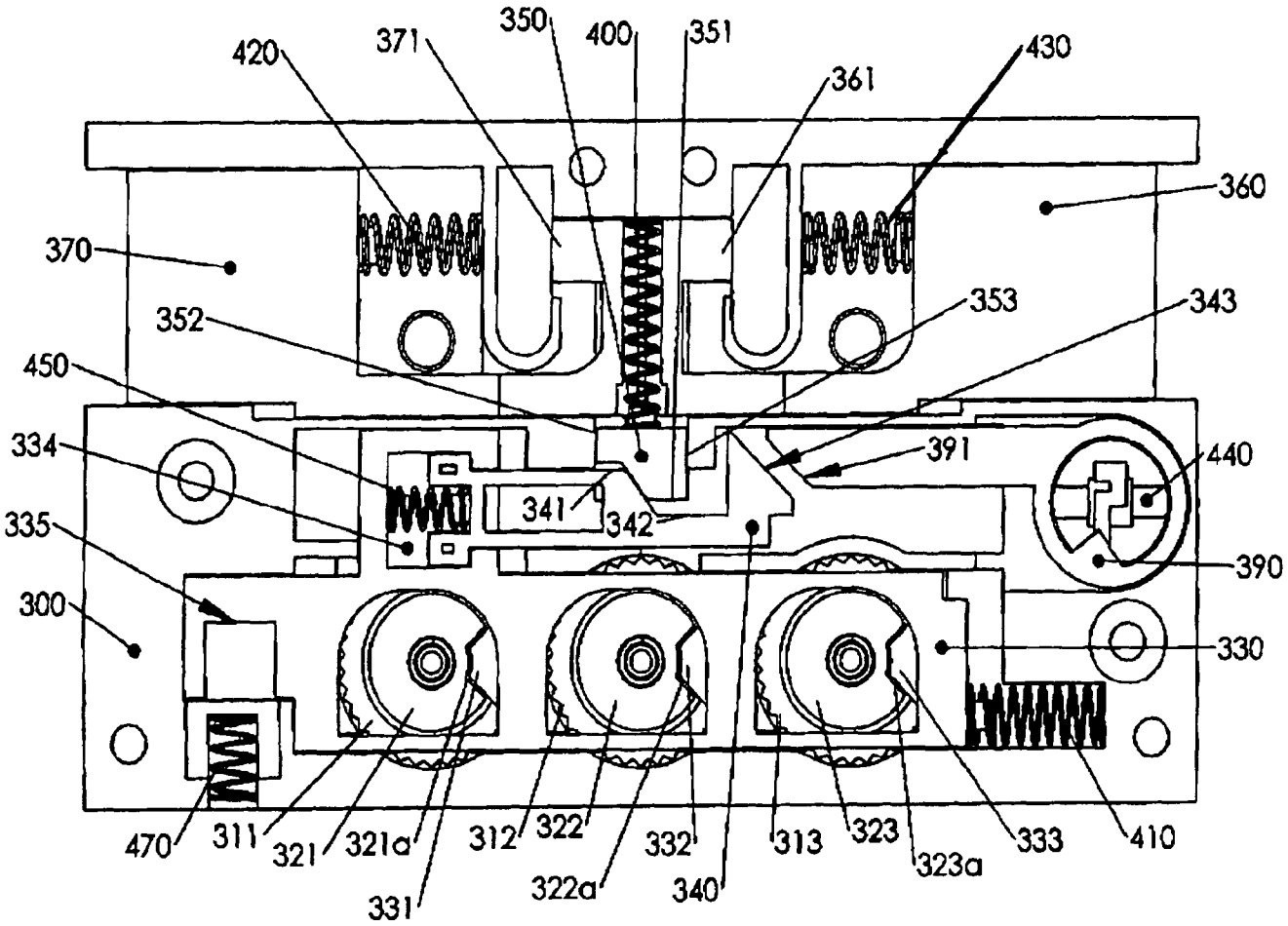
FIG. 18 is a bottom plan view of the dual mode, zipper pull locking system of the present invention shown with the bottom cover removed and in the unlocked position by employing the combination controlled locking section thereof and in the process of being reset.
Figure 19:
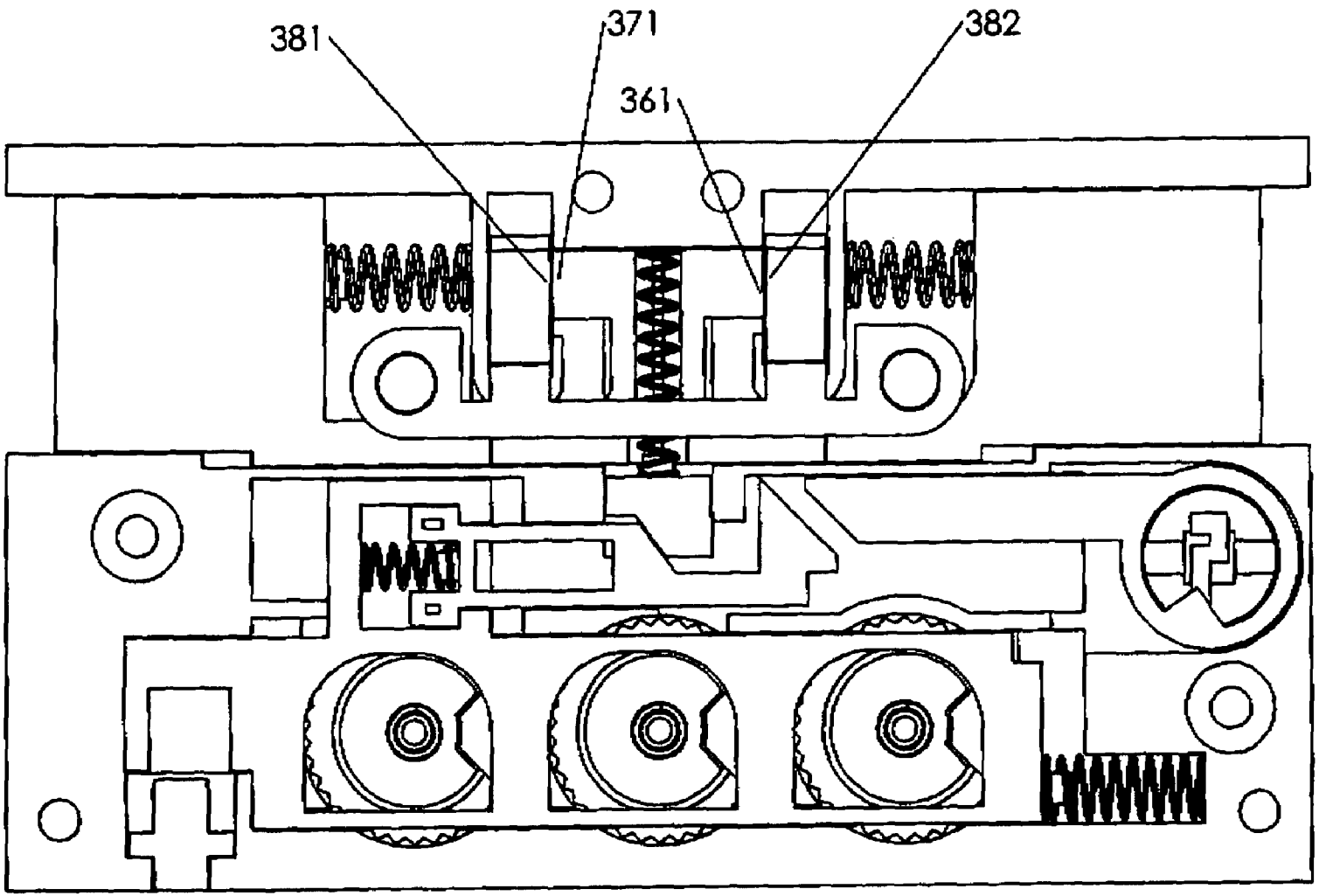
FIG. 19 is a bottom plan view of the dual mode, zipper pull locking system of the present invention shown with the bottom cover removed and in the unlocked position by employing the combination controlled locking section thereof.
Figure 20:
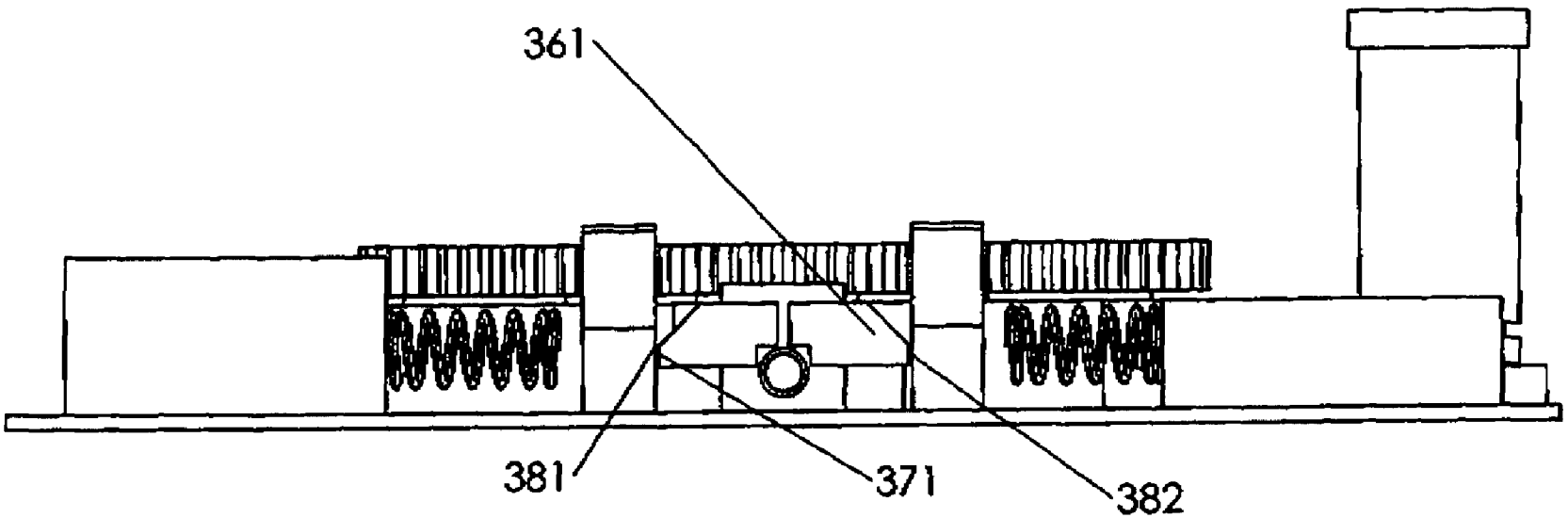
FIG. 20 is a side elevation view of the dual mode, zipper pull locking system of the present invention shown with the housing removed.
Figure 21:
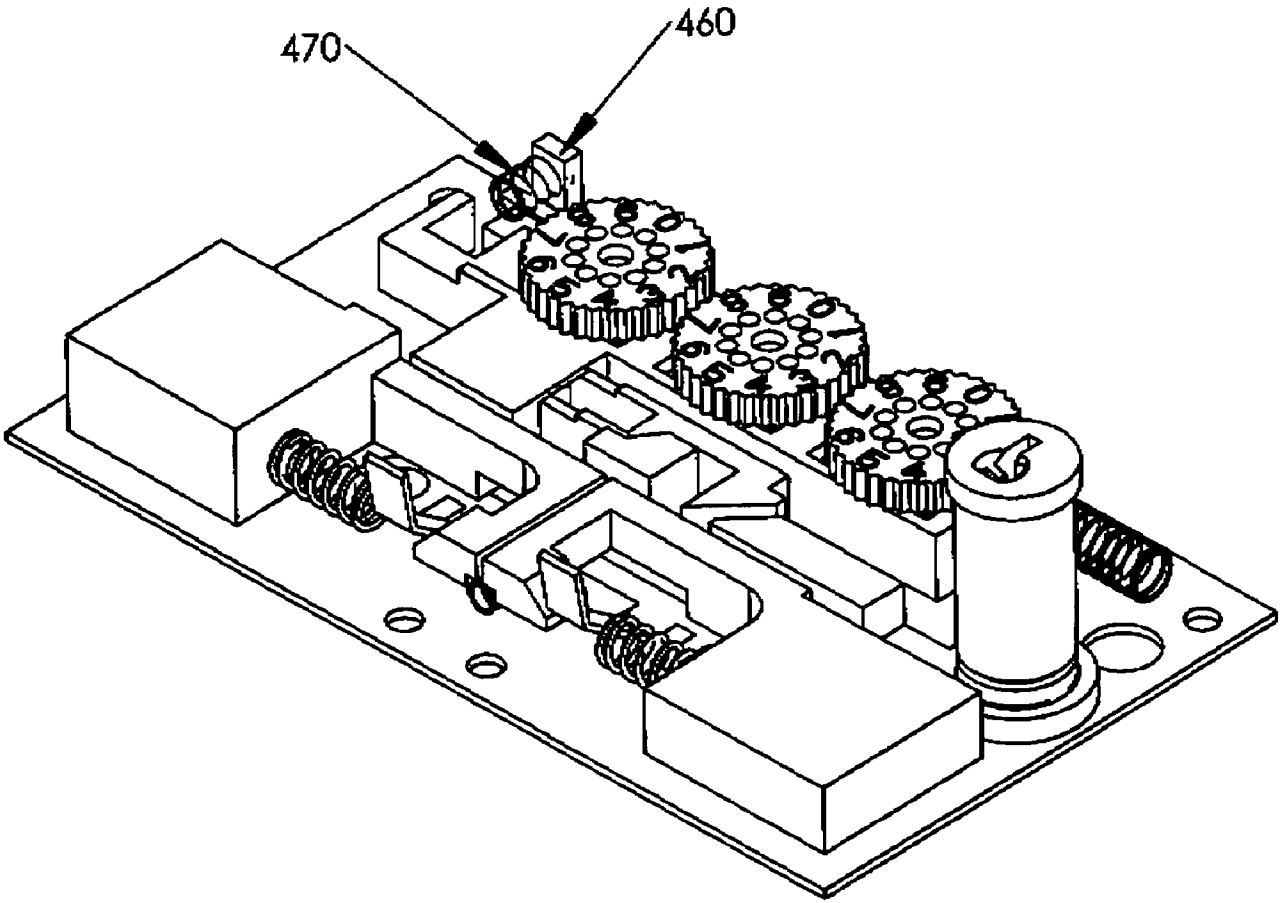
FIG. 21 is a top perspective view of the dual-mode, zipper pull locking system of the present invention shown with the housing removed.
Figure 22:
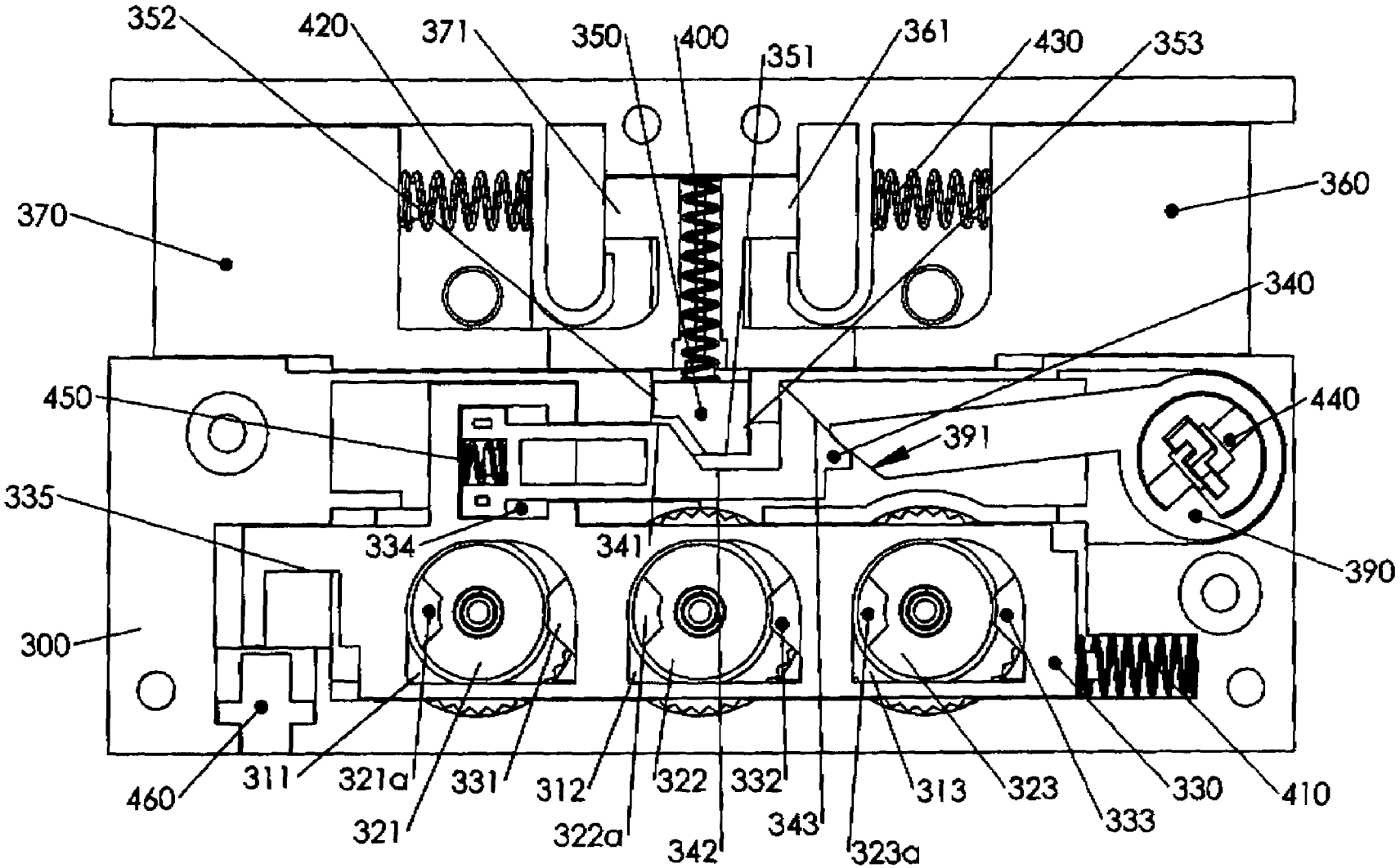
FIGS. 22 and 23 are bottom plan views of the dual-mode, zipper pull locking system of the present invention shown with the housing removed and in the unlocked position by employing the key controlled locking section.
Figure 23:
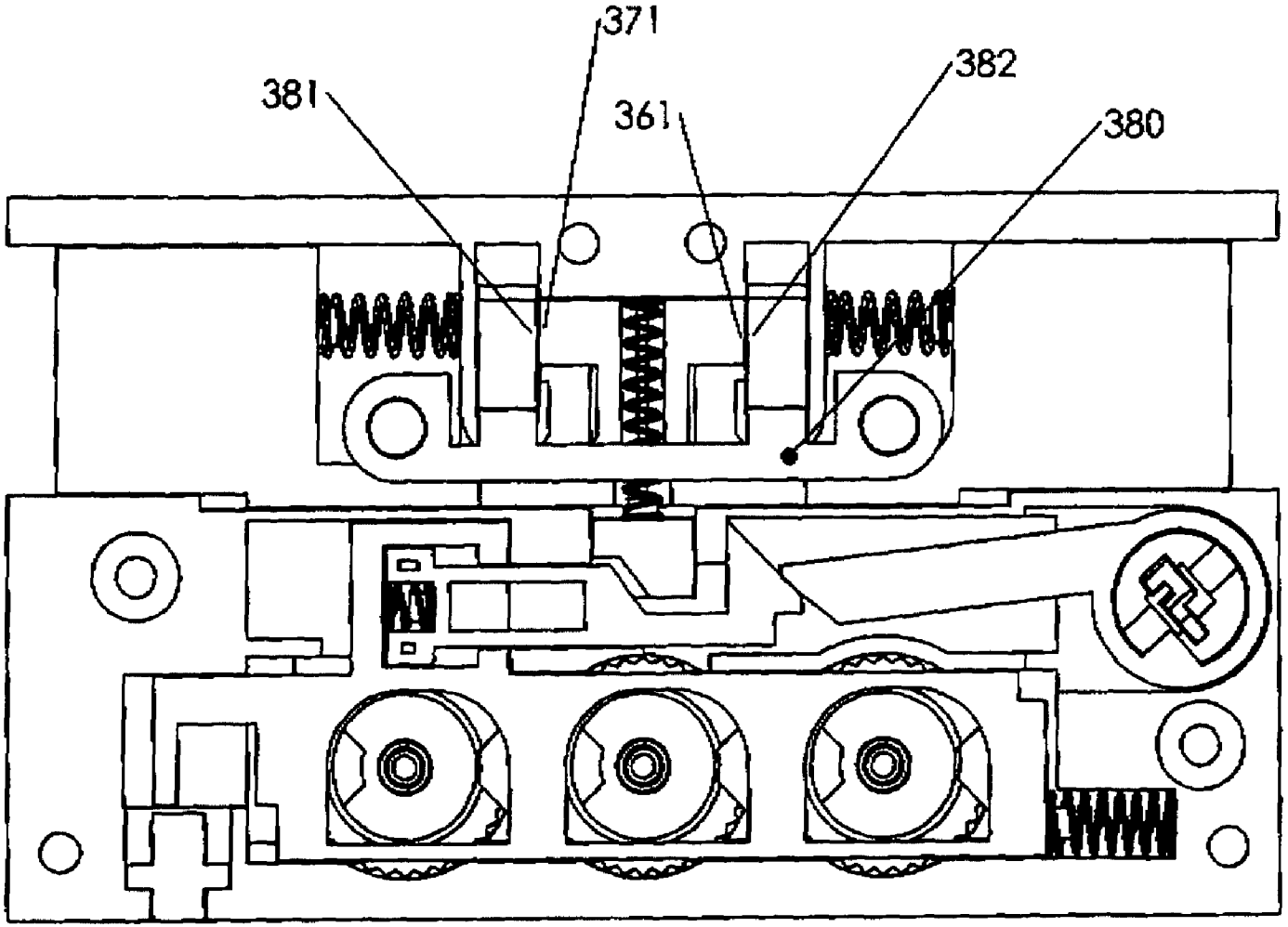
Figure 24:
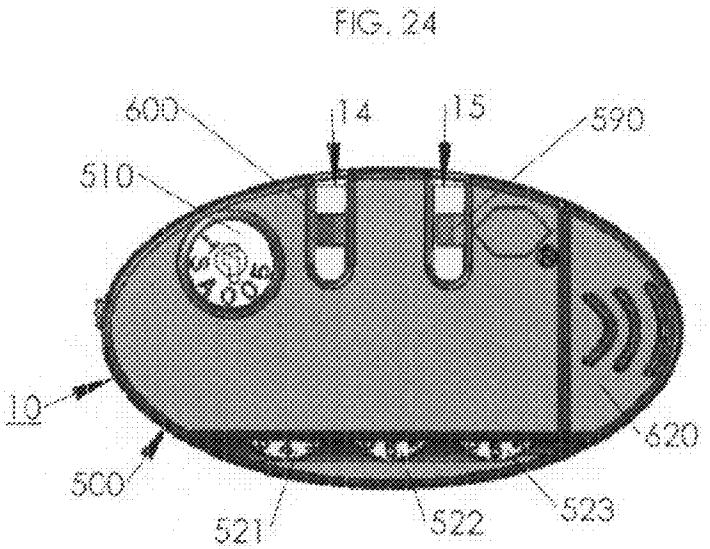
FIG. 24 is a top plan view of a third preferred embodiment of the dual-mode, zipper pull locking system of the present invention.
Figure 25:
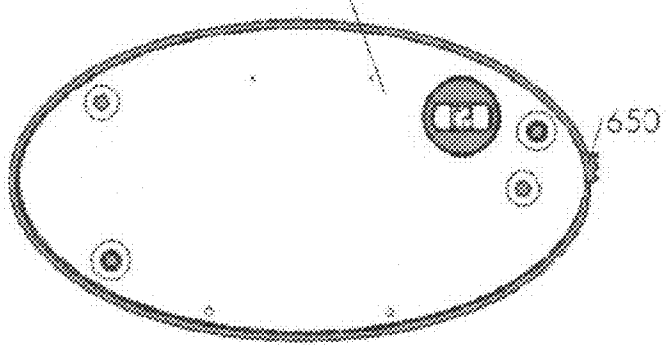
FIG. 25 is a bottom plan view of the dual-mode, zipper pull locking system of FIG. 24.
Figure 26:
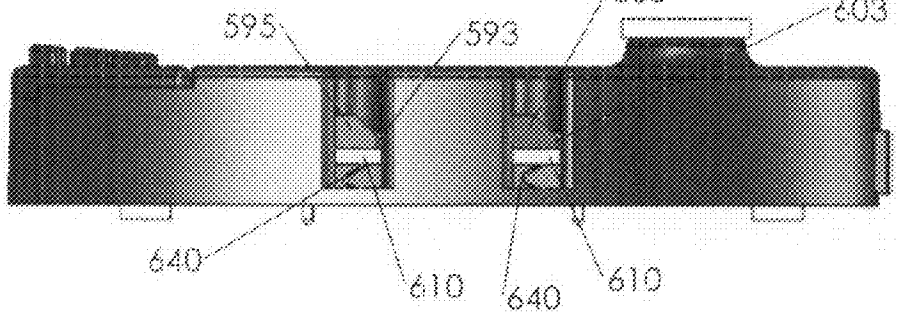
FIG. 26 is a side elevation view of the dual-mode, zipper pull locking system of FIG. 24.
Figure 27:
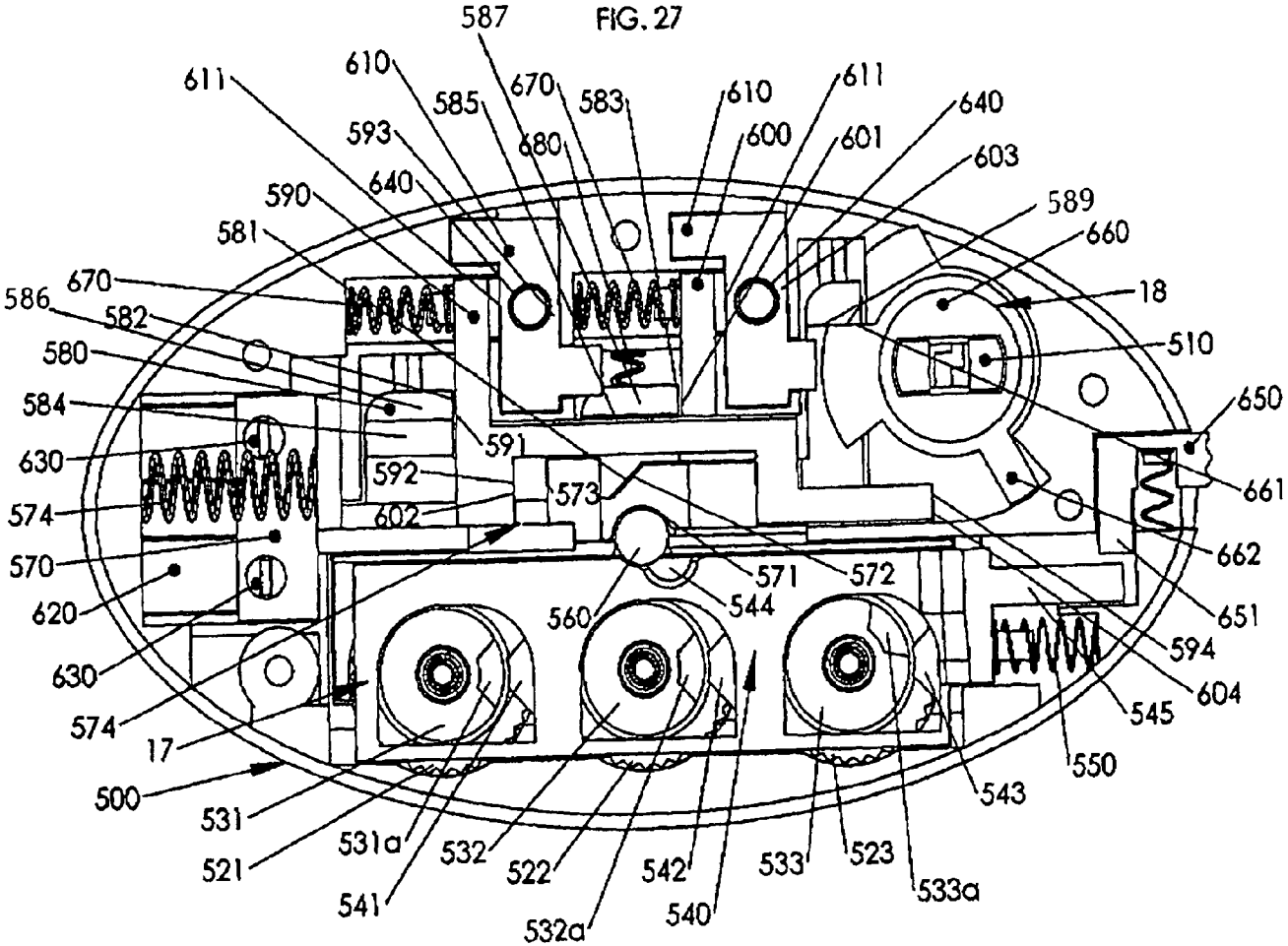
FIG. 27 is a bottom plan view of the dual-mode, zipper pull locking system of FIG. 24 with the bottom cover removed and shown in the locked position.
Figure 28:
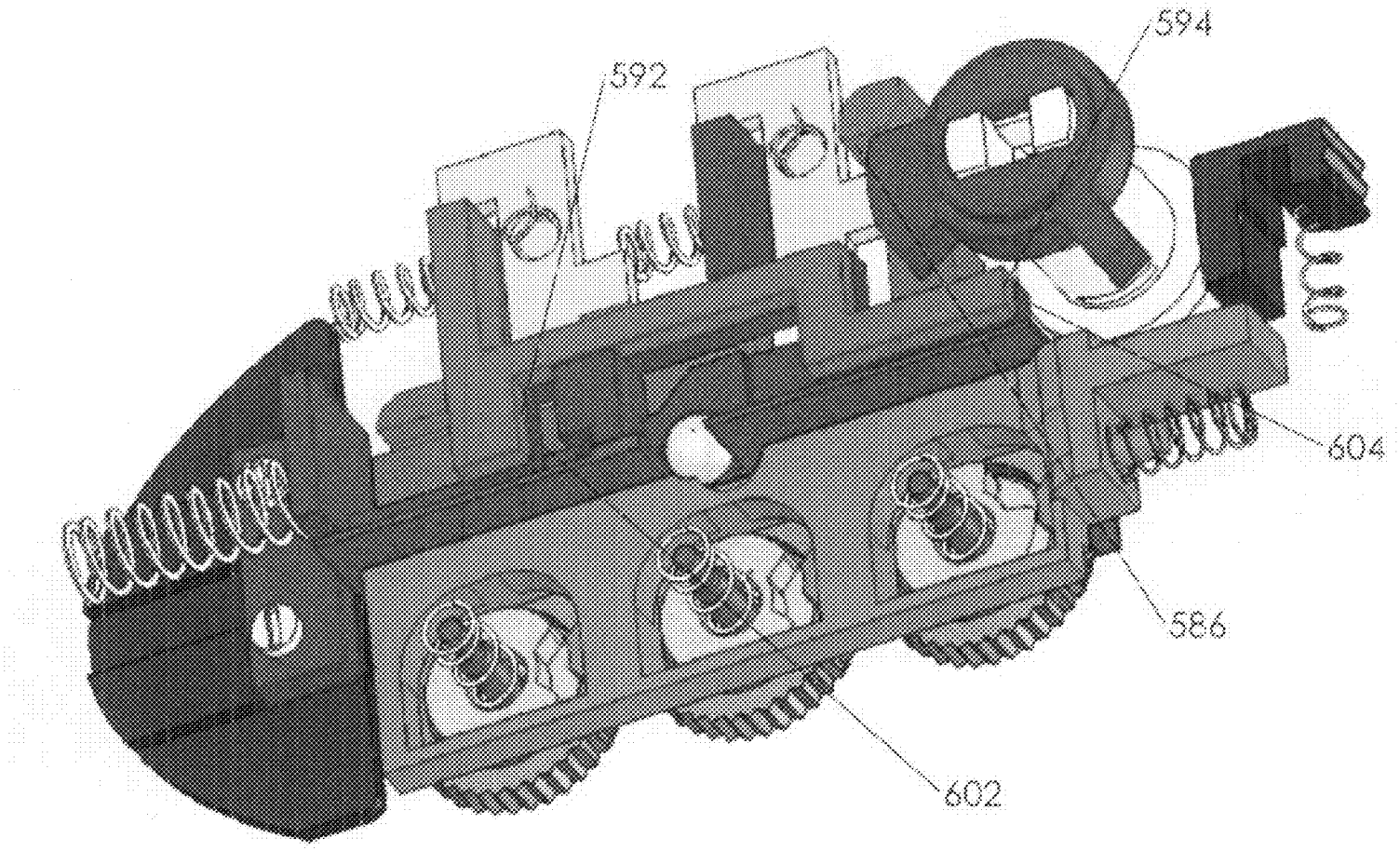
FIGS. 28 and 29 are bottom perspective views of the dual-mode, zipper pull locking system of FIG. 27, shown with the housing removed.
Figure 29:
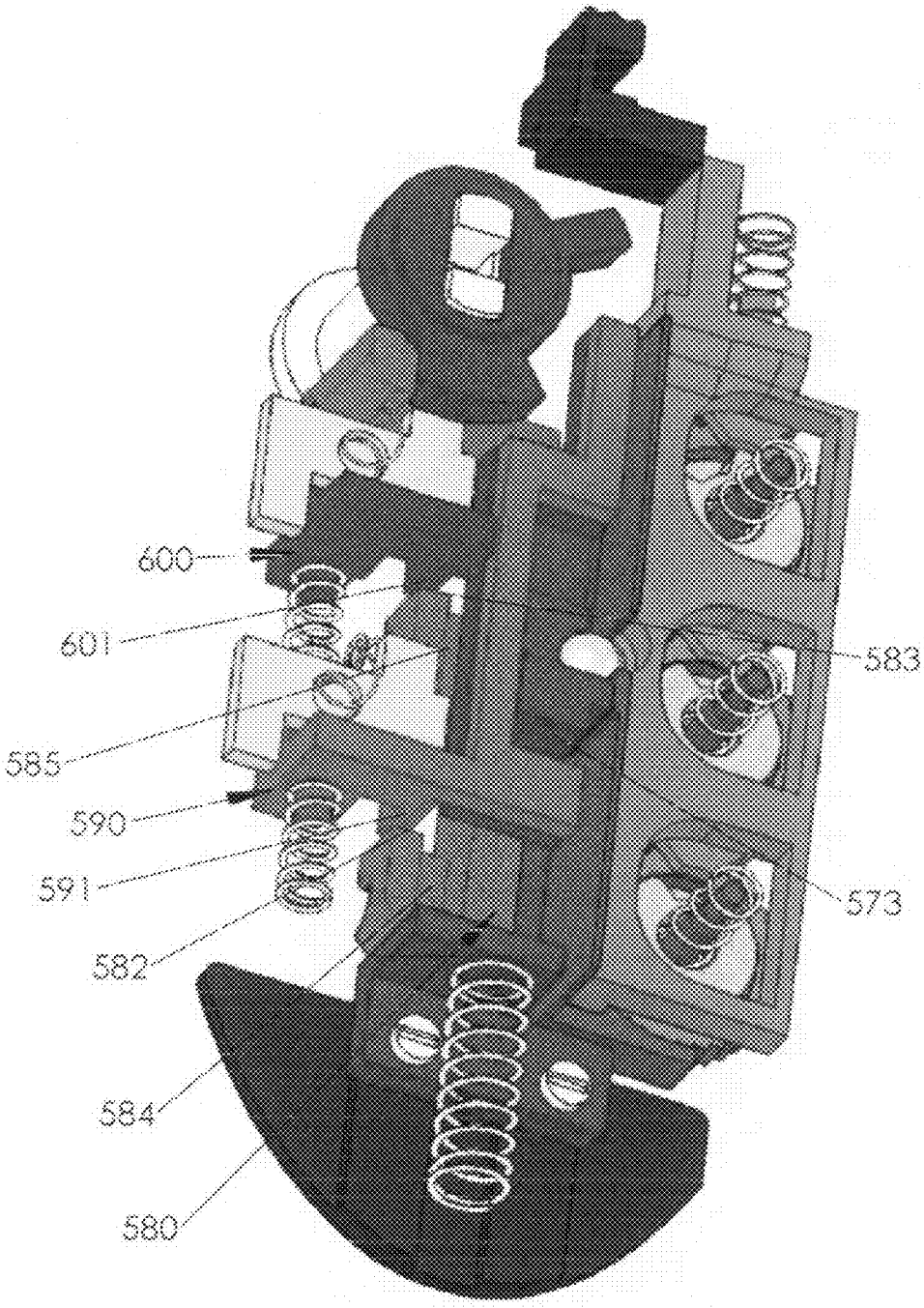
Figure 30:
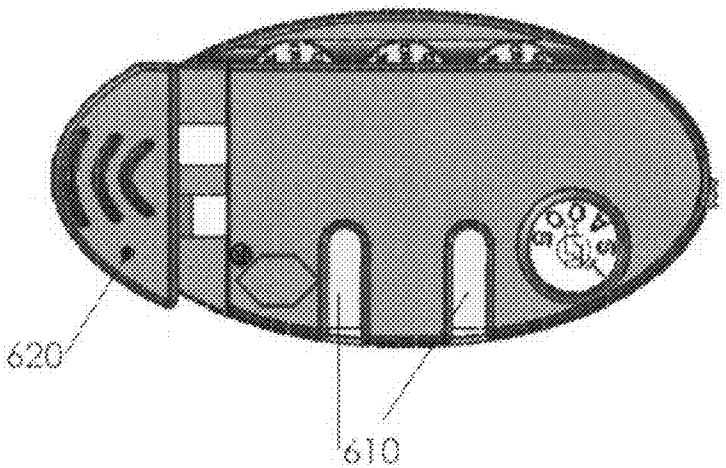
FIG. 30 is a top plan view of the dual-mode, zipper pull locking system of FIG. 24 shown in the unlocked position by employing the combination controlled locking section.
Figure 31:
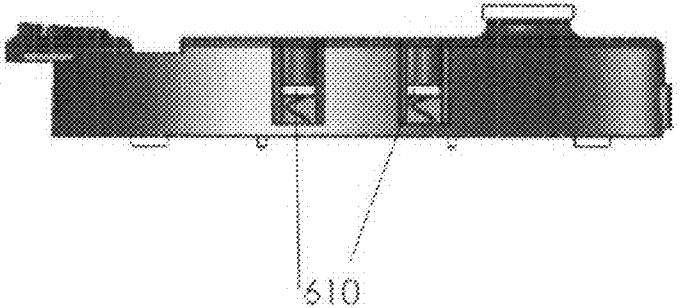
FIG. 31 is a side elevation view of the dual-mode, zipper pull locking system of FIG. 30.
Figure 32:
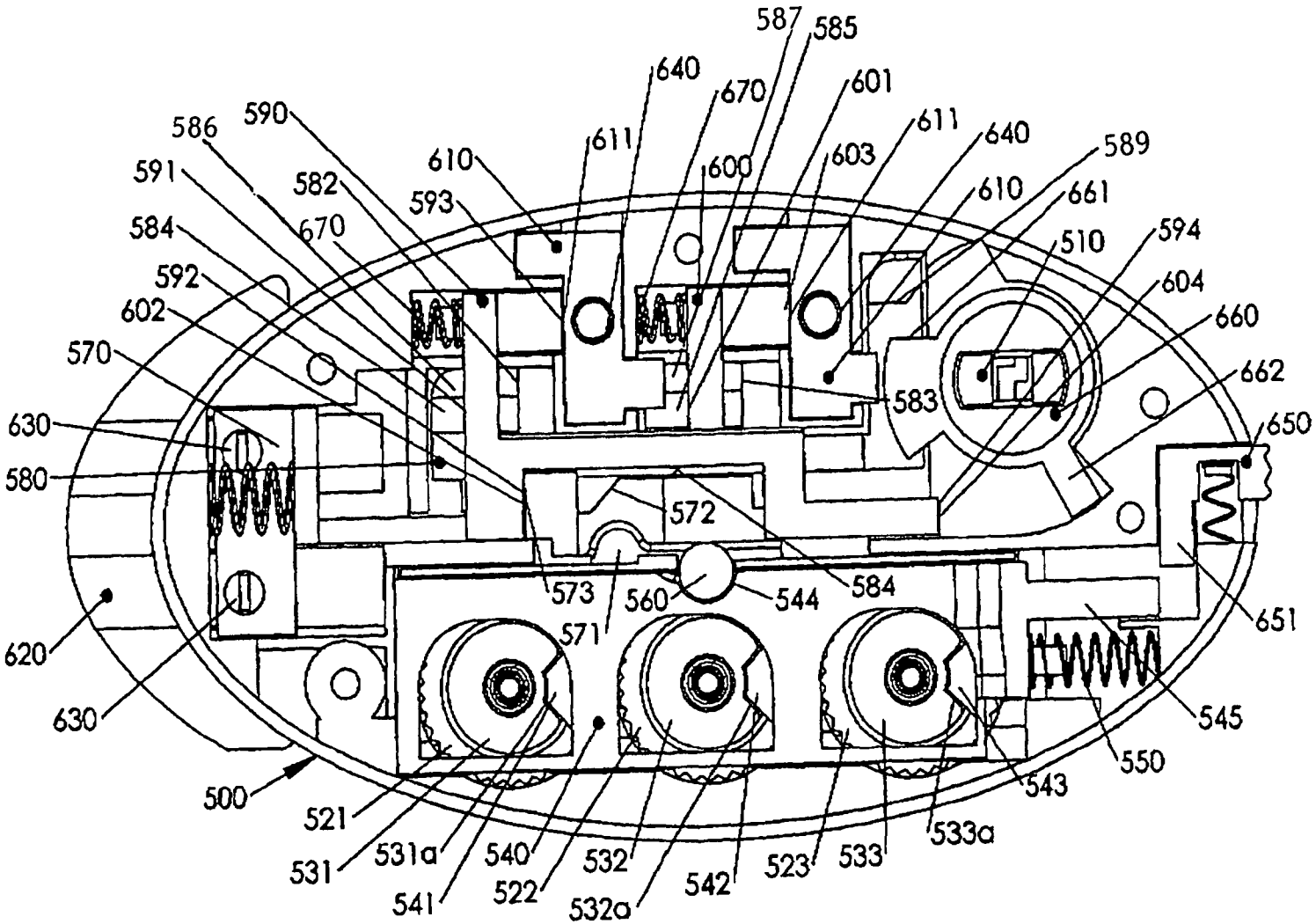
FIGS. 32 and 33 are bottom plan views of the dual-mode, zipper pull locking system of FIG. 30 shown with the cover removed.
Figure 33:
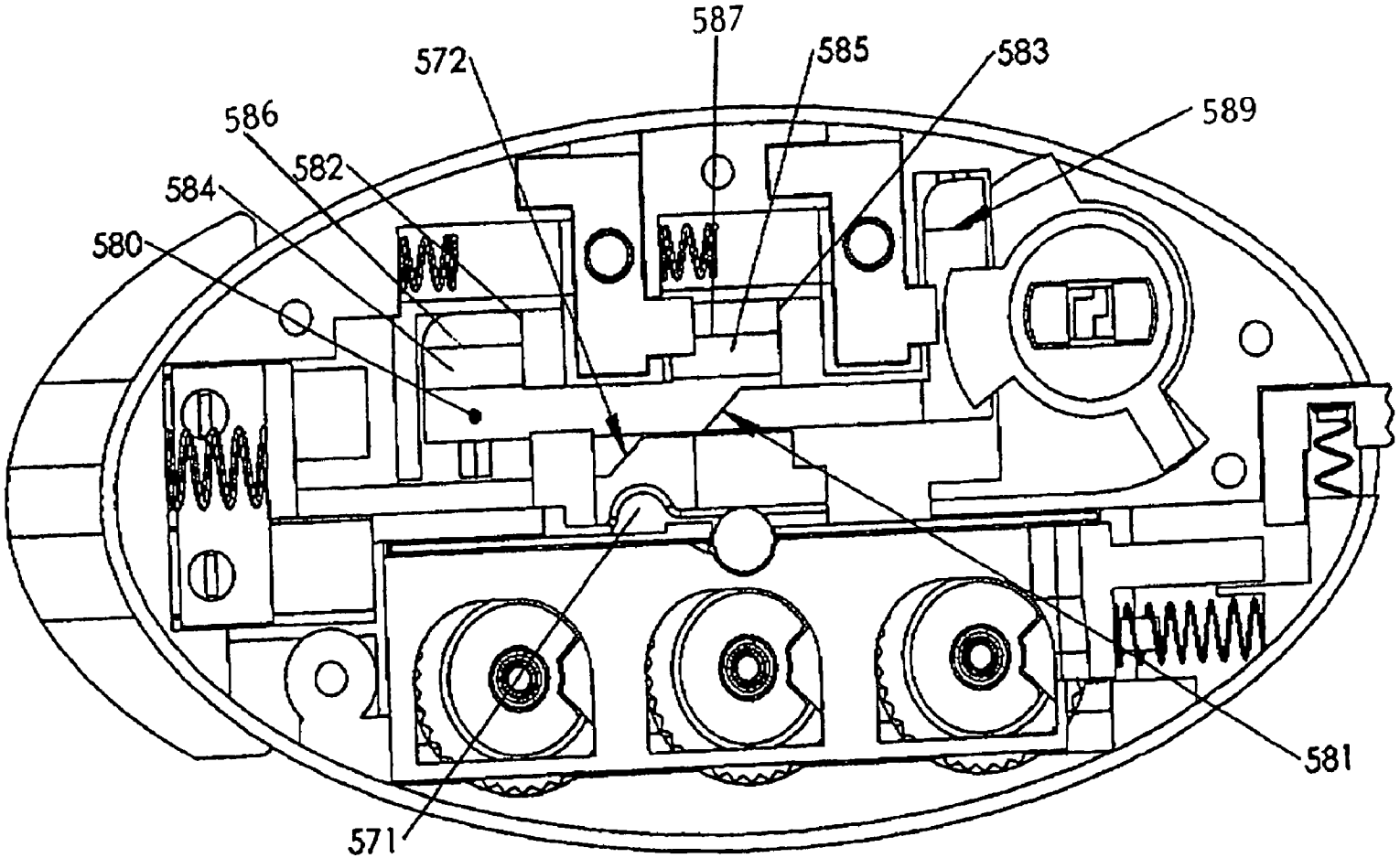
Figure 34:
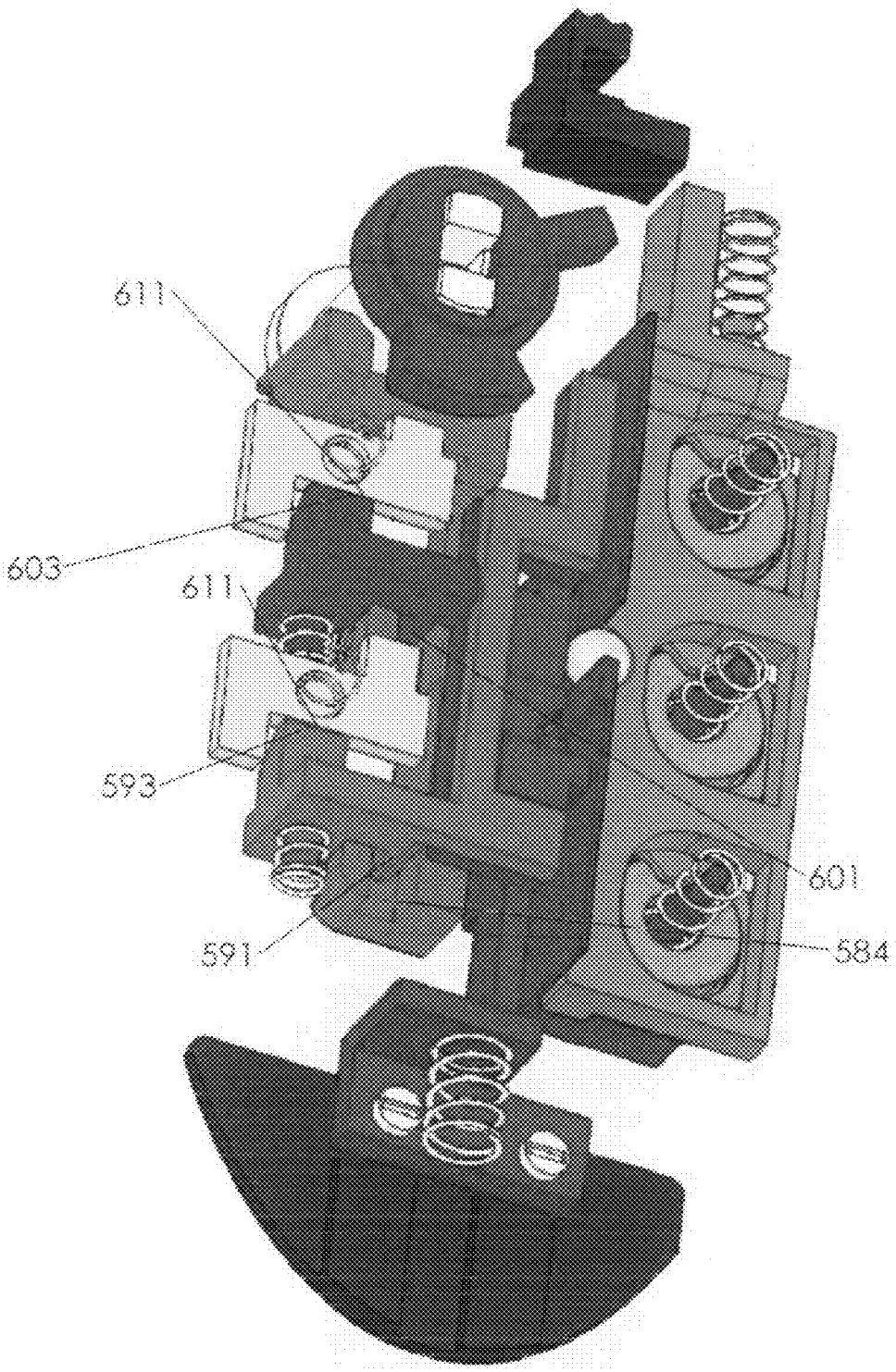
FIG. 34 is a bottom perspective view of the dual-mode, zipper pull locking system of FIG. 30, shown with the housing removed.
Figure 35:
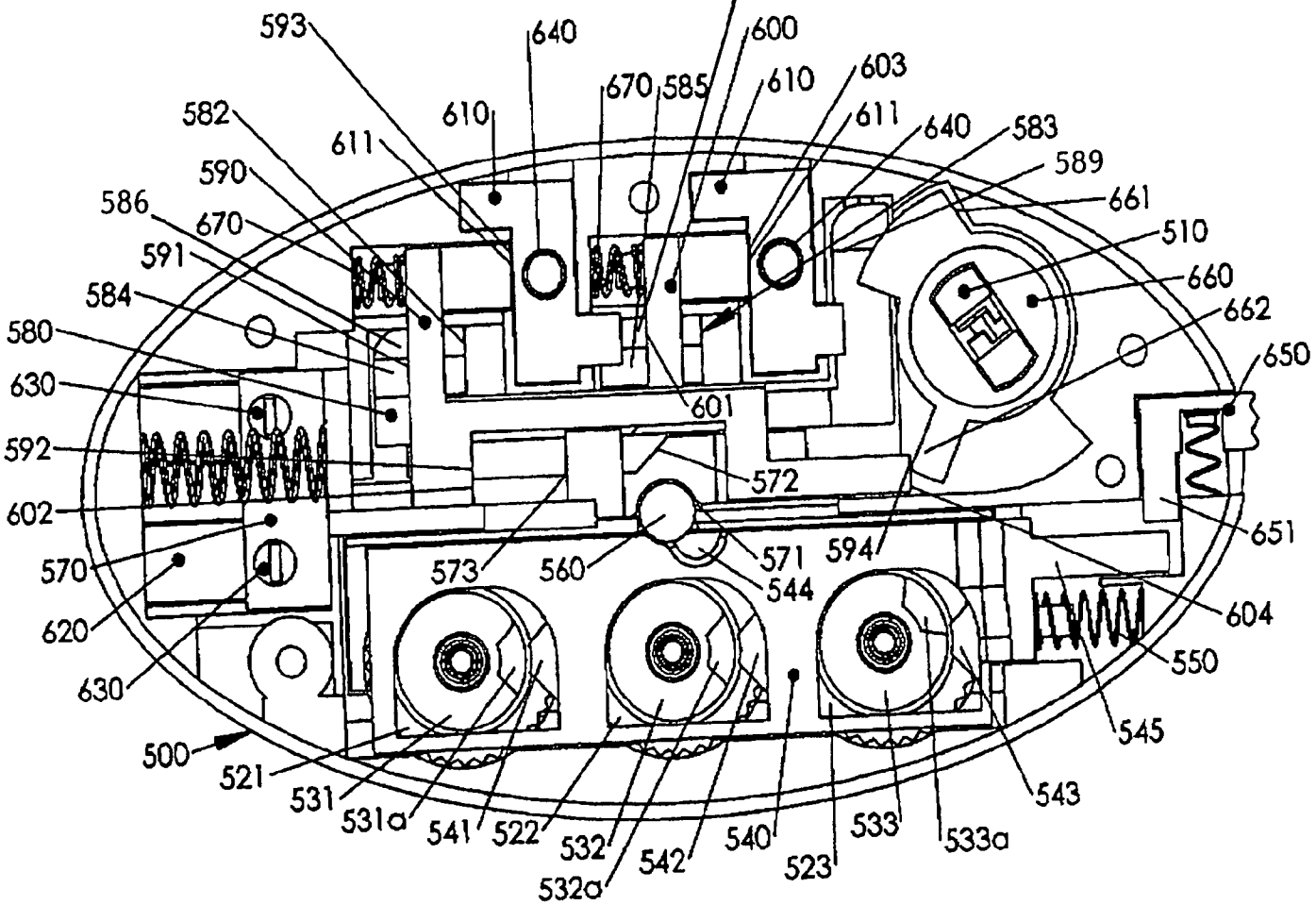
FIG. 35 is a bottom plan view of the dual-mode, zipper pull locking system of FIG. 24 shown with the bottom cover removed and in the unlocked position using the key controlled locking section.
Figure 36:
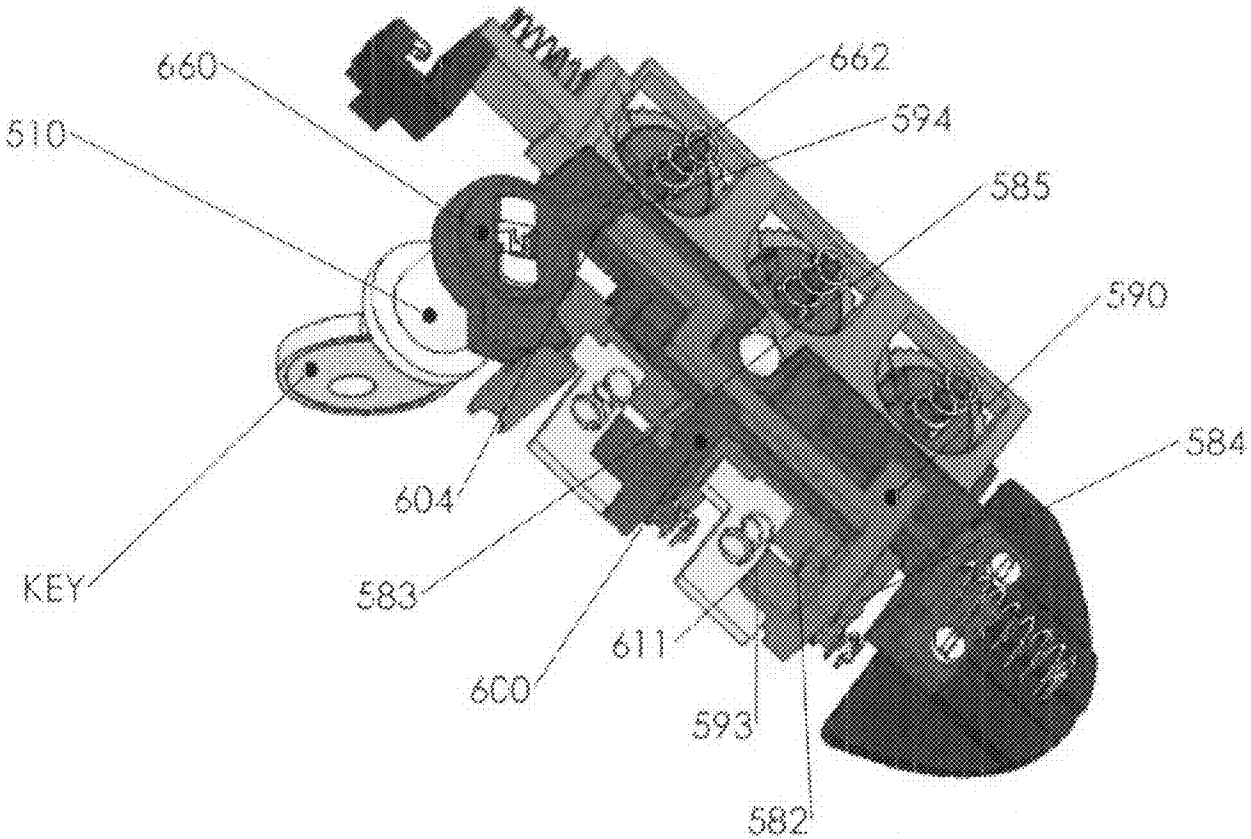
FIG. 36 is a bottom perspective view of the dual-mode, zipper pull locking system of FIG. 35 shown with the bottom cover and housing removed.

Once locking plate 330 has been moved in housing 300, as detailed above, carrying zone 334 of locking plate 330 moves therewith, causing control plate 340 to move also. As depicted, control plate 340 is biased by spring 450 to remain in its original position as depicted in FIG. 16. However, when locking plate 330 moves due to the correct pre-set combination being entered on dials 311, 312, and 313, locking plate 330 causes control plate 340 to move therewith, due to the capture of the terminating end of control plate 340 in carrying zone 334.

As shown, the movement of control plate 340 causes cut out zone 342 of control plate 340 to move into alignment with blocking element 350. Since blocking element 350 is biased by spring 400 to move towards control plate 340, the movement of cut out zone 342 into alignment with blocking plate 350 allows blocking plate 350 to move into cutout zone 342. As a result, edges 352 and 353 of blocking plate 350 are removed from blocking engagement with the edges of latch members 360 and 370, enabling latch members 360 and 370 to be moved in housing 300.

In this embodiment of the present invention, each latch member 360 and 370 comprises a plate member, a surface of which is separately exposed on the top of housing 300. As a result once blocking element 350 has been moved, as detailed above, each latch member 360 and 370 can be separately moved by the user sliding latch member 360 and/or 370 inwardly, into housing 300. This movement causes locking elements 365 and 375 to move out of engagement with the zipper pull retained thereby, releasing the zipper pull. As a result, the user is able to individually release one zipper pull or both zipper pulls when desired.

In the preferred construction, zipper pull locking system 10 also incorporates a spring plate 380 which is associated with the locking latch members 360 and 370, and the zipper pull engaging elements 365 and 375 thereof. In addition, spring plate 380 is continuously biased in a direction towards zipper pull engaging element 365 and 375. As a result, whenever locking latch members 360 and 370 have been moved into the released position, causing zipper pull engaging elements 365 and 375 to be withdrawn from the zipper pull associated therewith, spring plate 380 causes the zipper pull to pop up and be automatically released therefrom.

In addition, as spring plate 380 moves upwardly, the side edges 381 and 382 thereof move between housing 300 and the surfaces 361 and 371 of zipper pull engaging elements 365 and 375, preventing locking latch members 360 and 370 from returning to their original position.

As a result of this construction, locking latch members 360 and 370 are only able to move back to their locking position when a zipper pull is inserted into zipper receiving zones 14 and 15 and spring plate 380 is moved downwardly, causing side edges 381 and 382 of spring plate 380 to be moved out of engagement with surfaces 361 and 371 of locking latch members 360 and 370. Once this blocking engagement is removed, locking latch members 360 and 370 automatically move back into engagement with the zipper pulls, due to the biasing forces being exerted by springs 420 and 430.

Whenever combination controlled section 17 of locking system 10 is in its open or unlocked position, as detailed above, the preset combination can be changed, if desired. Once locking plate 330 is laterally moved in housing 300 by spring 410, receiving zone 335 is aligned with pushbutton 460. By advancing pushbutton 460 into receiving zone 335, locking plate 330 is held in the unlocked or open position.

With the open position being secured, the user is able to rotate dials 311, 312, and 313 into any desired position for displaying a particular combination. Once the combination is set, the user removes the holding force from enabling spring 470 to force pushbutton 460 out of receiving zone 335.

In addition to opening lock system 10 by employing combination controlled section 17, lock system 10 may also be opened by employing key controlled section 18. By referring to FIGS. 14-23, along with the following detailed discussion, the construction and operation of system 10 for the locking and unlocking thereof by employing key controlled section 18 can best be understood. Furthermore, it should also be understood that alternate constructions of key controlled locking section 18 can be employed without departing from the scope of this invention. However, for exemplary purposes only, the preferred construction is fully detailed herein.

In this construction, key controlled locking section 18 of housing 300 of lock system 10 incorporates cylinder 440 which is mounted within a receiving cavity formed in housing 300 and constructed for enabling cylinder 440 to arcuately pivot whenever the correct key is inserted into the receiving slot formed in cylinder 440. In this regard, cylinder 440 incorporates a tumbler construction which is aligned in a precisely desired configuration whenever the matching key is inserted into the receiving slot thereof. Once inserted, the pivoting movement of cylinder 440 is attained.

As shown in the Figures, cylinder 440 incorporates cam plate 390 mounted to the distal end thereof and constructed for arcuate pivoting movement simultaneously with the arcuate movement of cylinder 440 in response to the insertion and use of the correct key member. As a result, whenever the correct key has been inserted into the receiving slot formed in cylinder 440, and the key is employed to pivot cylinder 440, cam plate 390 simultaneously pivots therewith.

As depicted, in the preferred construction, cam plate 390 incorporates a radially extending arm 391. Upon insertion of the appropriate key into the cylinder 440, cylinder 440 is rotated by employing the key which simultaneously causes cam plate 390 to rotate therewith. This rotation causes arm 391 to rotate therewith, forcing the slanted or sloping edge of arm 391 to contact slanted/sloping edge 343 of control plate 340. As cylinder 440 continues to be rotated, arm 391 forces edge 343 and control plate 340 to move longitudinally within housing 300 against the biasing force of spring 450.

As the movement of control plate 340 continues, wall 341 moves out of blocking engagement with edge 351 of blocking element 350. In addition, cutout zone 342 becomes aligned with blocking element 350 to be forced into cutout zone 342 by spring 400. Since carrying zone 334 of locking plate 340 is enlarged, control plate 340 is able to move without interfering with locking plate 330.

Once blocking element 350 enters cutout zone 342 of control plate 340, sides 352 and 353 of blocking element 350 are removed from blocking relationship with latch members 360 and 370, enabling latch members 360 and 370 to be opened by the user when desired, as described above. Furthermore, once the zipper pulls have been removed, the key inserted into cylinder 440 can be removed, thereby satisfying new security regulations.

In FIGS. 24-36, the third preferred embodiment of zipper pull locking system 10 and of the present invention is depicted. By referring to these Figures, along with the following detailed discussion, the construction and operation of this third preferred embodiment can best be understood. Furthermore, as is evident from this disclosure, a minimum number of principal components are employed, thereby achieving a zipper pull locking system which also substantially reduces the complexity found in most prior art systems. In this way, the invention provides a highly effective, commercially desirable construction which is capable of being produced at competitive costs, while also providing the unique attributes of the present invention and all of the locking and theft deterrent features typically incorporated in prior art locking systems.

As discussed above, all of the embodiments of the present invention incorporate uniquely constructed, interconnected control plates, sliders, and cooperating components which are employed for controlling the movement of locking latches which securely engage the zipper pulls of any product on which the locking system of the present invention is employed. By employing one of the constructions detailed herein, a highly effective, easily produced, dual mode locking system is realized which is capable of providing all of the attributes desired in a highly effective, competitively priced, zipper pull locking system.

In this preferred embodiment of the present invention, one of the principal components forming the zipper pull locking system 10 is housing 500 which incorporates zipper pull receiving and holding zones 14 and 15. As is well known in the art and discussed above, in the typical construction of any zipper employed on suitcases, briefcases, and other similar products, two separate and independent zipper pulls are employed for allowing the zipper to be opened and closed from a wide variety of alternate positions. Furthermore, each of the zipper pulls incorporates a tab member, typically formed from plastic or metal, with an enlarged opening or aperture formed therein. By employing the aperture formed in each zipper pull, the locking system of the present invention is able to securely engage each of the zipper pulls in separate retaining zones, maintaining the zipper pulls completely locked and secured to housing 500 of locking system 10.

Furthermore, this embodiment of the present invention also incorporates combination controlled locking section 17 and key control locking section 18, both of which are contained in housing 500. In addition, as is fully detailed in the following disclosure, key control locking section 18 in combination with controlled locking section 17 are constructed in a manner which independently activates the cooperating locking plates and sliders mounted in housing 500 for causing the associated zipper pull latching members to move in a direction which releases the zipper pulls secured thereto. In this way, all of the embodiments of the present invention provide for this secure locking and controlled release of each of the two zipper pulls, when desired, by the activation of either the combination controlled locking section or the key controlled locking section.

In the third preferred embodiment of the present invention, as depicted in FIGS. 24-36, zipper pull locking system 10 incorporates, in addition to the components detailed above, zipper pull locking latch members 590 and 600. As depicted and detailed herein, zipper pull locking latch member 590 is constructed for moving relative to zipper pull receiving zone 14, while zipper pull locking latch member 600 is constructed for moving relative to zipper pull receiving zone 15. In this regard, both zipper pull locking latch members 590 and 600 are constructed for lateral movement into and out of the area defined by receiving zones 14 and 15, for enabling each zipper pull locking latch member 590 and 600 to securely engage the aperture formed in the associated zipper pull for securely retaining the zipper pull to housing 500, while also enabling the zipper pulls to be disengaged therefrom when desired.

As depicted throughout the Figures, zipper pull locking latch members 590 and 600 each comprise elongated, longitudinally extending integrated sections which are mounted in housing 500 for enabling latch members 590 and 600 to move in a desired, controlled direction. In this regard, zipper pull engaging elements 595 and 605 are formed as a component of latch members 590 and 600 and represent the component of latch members 590 and 600 which are inserted directly into the apertures formed in the zipper pulls for controlling the locking engagement and release of the zipper pulls when desired. The remaining construction of latch members 590 and 600 are employed for providing the desired movement of zipper pull engaging elements 595 and 605.

As more fully detailed below, zipper pull engaging elements 595 and 605 are automatically advanced into locked engagement with the apertures of each zipper pull whenever the zipper pull is inserted into the zipper pull receiving zones 14 and 15. This automatic locking engagement is achieved by the biasing forces provided by spring members 670 acting on latch members 590 and 600.

In order to achieve the desired control movement of zipper pull locking latch members 590 and 600, locking system 10 incorporates control plate 580 as a principal element for achieving the desired movement. As depicted, and fully detailed below, control plate 580 effectively blocks any lateral movement of zipper pull locking latch members 590 and 600 into the locked position, while enabling latch members 590 and 600 to move laterally whenever control plate 580 has been moved out of blocking relationship therewith.

In this regard, in order to best understand the cooperating relationship between control plate 580 and zipper pull locking latch members 590 and 600, it is important to understand the cooperating blocking and release construction and interengaged relationship of the component portions forming a part of these inter-related members. In this regard, as is fully detailed below, and shown in FIGS. 24-36, particularly FIG. 29, control plate 580 incorporates blocking edge or wall 582 which forms a part of post 586, and blocking edge or wall 583 which forms a part of post 587. As detailed below, blocking edges/walls 582/583 are positioned for cooperating with sidewalls 591 and 601 of latch members 590 and 600.

As shown in the drawings, these cooperating elements are positioned for blocking interengagement with each other when control plate 580 is in a first position, and enabling lateral movement relative to each other when control plate 580 is in its second position. Furthermore, control plate 580 incorporates a cavity or slot 584 formed therein directly adjacent post 586 and a cavity or slot 585 formed adjacent post 587. In the preferred construction, cavities/slots 584/585 are dimensioned for enabling sidewalls 591/601 to freely move therein, thereby enabling latch members 590/600 to be freely movable.

Whenever the user wishes to employ combination controlled locking section 17 of this embodiment of the present invention, the plurality of indicia bearing rotatable dials 521, 522, and 523 are employed. As detailed above in regard to the other embodiments, rotatable dials 521, 522, and 523 are employed for setting and inputting the desired combination for locking and unlocking zipper pull locking system 10. In order to enable the user to readily display any desired combination, housing 500 preferably comprises a display area formed therein for enabling the indicia formed on the rotatable dials to be readily visible. In general, the construction of combination controlled locking section 17 is similar to the construction detailed above, as well as detailed in U.S. Pat. No. 6,408,660, the pertinent portions of which are hereby incorporated by reference.

As depicted, each of the rotatable dials 521, 522, and 523 are mounted in cooperating relationship with one of the clutch plates or rings 531, 532, and 533. Furthermore, in order to maintain clutch plates or rings 531, 532, and 533 in frictional engagement with dials 521, 522, and 523, a spring member is co-axially associated with each assembly to provide the required biasing force for maintaining each clutch ring in continuous frictional engagement with its associated dial. In this way, rotational movement of dials 521, 522, and 523 about their central axis causes clutch rings 531, 532, and 533 to rotationally move therewith.

Although the detailed construction and operation of dials 521, 522, and 523, and cooperating clutch rings 531, 532, and 533 are fully detailed below and in U.S. Pat. No. 6,408,660, one structural feature which is important to note is the incorporation of a slot 531*a*, 532*a*, and 533*a*, in each clutch ring 531, 532, and 533. As detailed herein, each slot 531*a*, 532*a*, and 533*a* of each clutch ring 531, 532, and 533 controls locking and unlocking system 10 in combination with the rotation of dials 521, 522, and 523.

In order to provide the desired locking and controlled release of the zipper pulls from zipper pull engaging elements 595 and 605 whenever combination controlled locking section 17 is employed, combination controlled locking section 17 incorporates locking plate 540. In its preferred construction, locking plate 540 incorporates finger members 541, 542, and 543, each of which are aligned with one of the slots 531*a*, 532*a*, and 533*a* formed in clutch rings 531, 532, and 533. In addition, locking plate 540 is continuously biased by spring member 550 into engagement with clutch rings 531, 532, and 533, thereby causing locking plate 540 to automatically move into engagement with the clutch rings whenever slots 531*a*, 532*a*, and 533*a*, are aligned with finger members 541, 542, and 543.

Whenever all three slots are placed in aligned relationship with all three finger members, which is achieved only when the desired preset combination has been input onto rotatable dials 521, 522, and 523, locking plate 540 automatically moves due to the spring forces imposed thereon. However, whenever an incorrect combination is entered on dials 521, 522, and 533, one or more of slots 531*a*, 532*a*, and 533*a* will be placed in a position which is not aligned with one of the associated fingers 541, 542, and 543. As a result, locking plate 540 will be incapable of movement, resulting in locking system 10 being maintained in the locked position.

Once locking plate 540 has been moved in housing 500, as detailed above, ball receiving zone 544 of locking plate 540 moves therewith, effectively becoming aligned with steel ball 560. Once receiving zone 544 is aligned with steel ball 560, ball 560 is able to drop into receiving zone 544. This movement removes steel ball 560 from blocking engagement in ball holding zone 571 of the slider plate 570, thereby enabling slider plate 570 to be longitudinally movable within housing 500.

Figure 37:
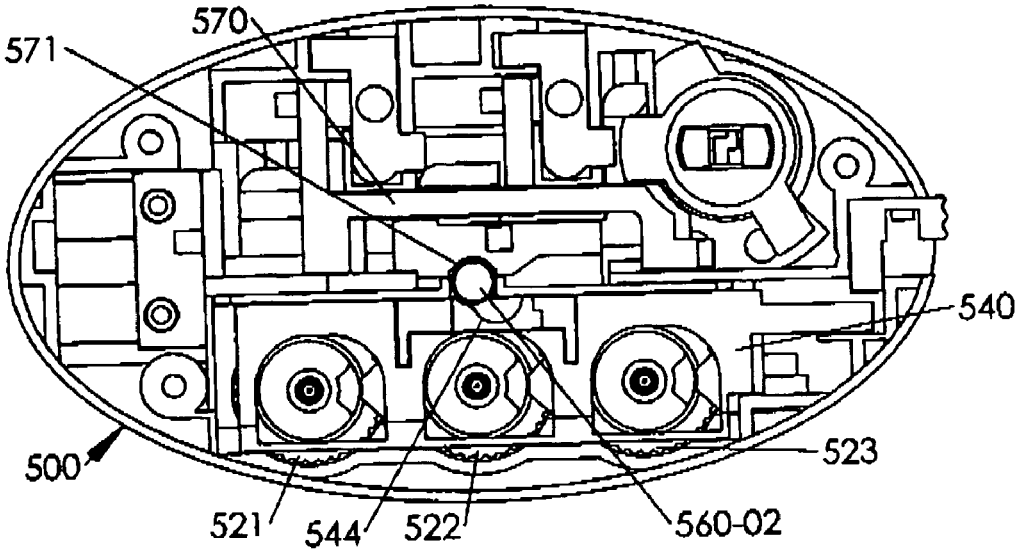
FIG. 37 is a bottom plan view of the dual-mode zipper pull locking system of FIG. 24 with the bottom cover removed and shown in the locked position, using an alternate component locking element.
Figure 38:
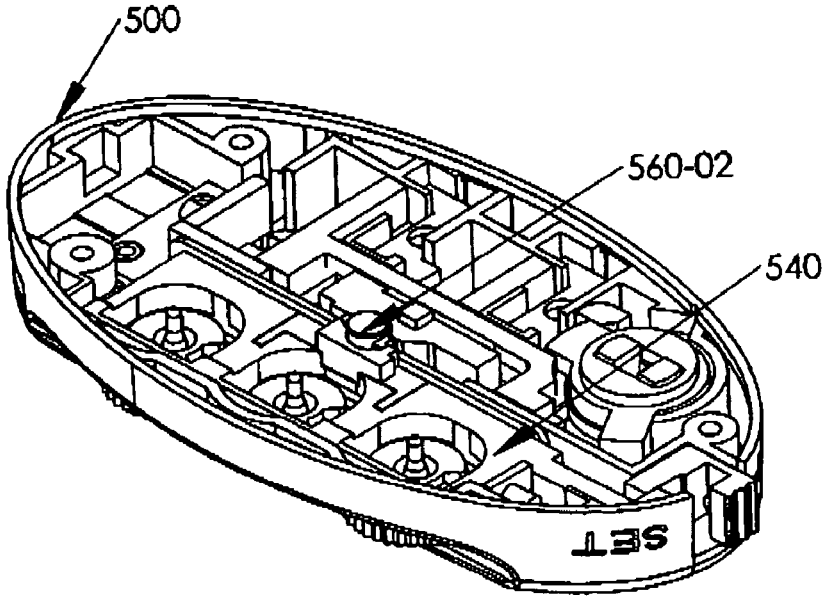
FIG. 38 is a bottom perspective view of the dual-mode zipper pull locking system of FIG. 37.
Figure 39A:
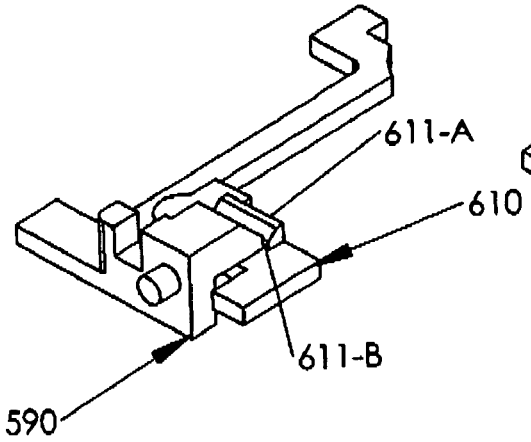
FIGS. 39A and 39B are perspective views of the latching components incorporated into the dual-mode zipper pull locking system of FIG. 24, wherein an alternate construction for the blocking plate is depicted.
Figure 39B:
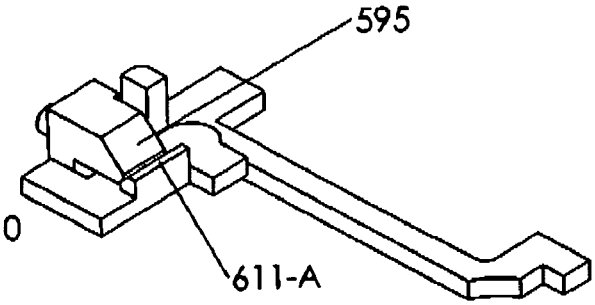
Figure 39C:
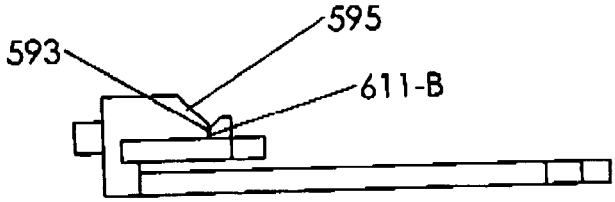
FIG. 39C is a side elevation view of the latching plate components depicted in FIG. 39B.
Figure 39C:
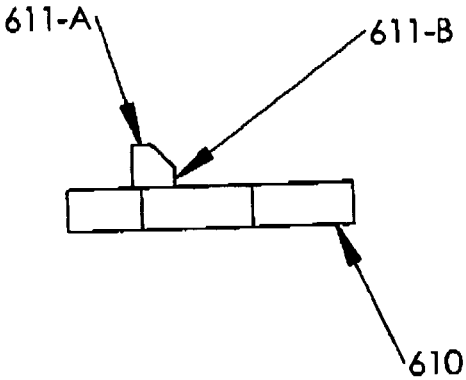
Figure 39C:
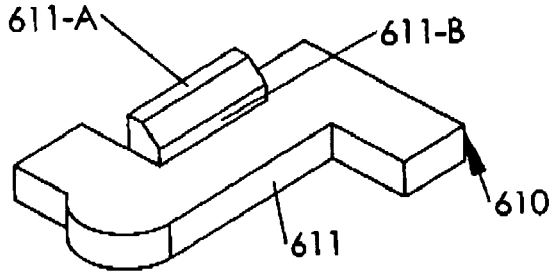

In FIGS. 37 and 38, an alternate embodiment for this construction is depicted. In this alternate embodiment, short metal roller, rod, or pin 560-02 is employed as a substitute for steel ball 560. In this alternate construction, locking plate 540 incorporates receiving zone 544 which is dimensioned for receiving roller, rod, or pin 560-02. Consequently, when the pre-determined, desired combination has been entered on dials 521, 522, and 523, locking plate 540 becomes movable, enabling receiving zone 544 to become aligned with roller, rod, or pin 560-02.

Once aligned, roller, rod, or pin 560-02 enters receiving zone 544, effectively removing roller, rod, or pin 560-02 from blocking engagement in holding zone 571 of slider plate 570. As a result, slider plate 570 is now able to be longitudinally movable within housing 500 for enabling activation panel 620 to be employed in the manner detailed above.

As depicted throughout the drawings, slider plate 570 preferably incorporates activation panel 620 which is securely affixed to slider plate 570 at one end thereof. Panel 620 is cooperatively associated with housing 500 in order to be readily accessible from the top surface thereof. In this way, the user is able to quickly and easily controllably move activation panel 620 and slider 570 whenever desired, once slider plate 570 is released. In addition, in order to maintain slider plate 570 in its unactivated position, a spring member 574 is mounted in housing 500 biasing slider plate 570 into its unactivated position. However, by moving activation panel 620, the user is able to overcome this biasing force and cause slider plate 570 to move longitudinally in housing 500, whenever steel ball 560 has been removed from engagement in holding zone 571.

Whenever slider plate 570 is moved against the biasing forces of spring member 574, sloping cam surface 572 contacts sloping surface 581 of control plate 580. As a result, the longitudinal advance of slider plate 570 in housing 500 causes cam surface 572 to contact sloping surface 581 of control plate 580, effectively forcing control plate 580 upwardly within housing 500. In the preferred construction, spring member 680 is mounted in biasing relationship with control plate 580, for maintaining control plate 580 in its initial position, wherein sloping surface 581 is engaged with cam surface 572 of slider plate 570. However, whenever slider plate 570 is longitudinally moved within housing 500, the engagement of cam surface 572 with sloping surface 581 of control plate 580 forces control plate 580 to move against the biasing force of spring member 680.

Once control plate 580 has been moved upwardly, blocking edges 582 and 583 of control plate 580 are disengaged from blocking alignment with sidewall 591 and 601 of zipper pull locking latch members 590 and 600, as fully discussed above. In addition, the longitudinal movement of slider plate 570 also causes upstanding protrusion or flange 573 of slider plate 570 to be brought into contact with surfaces 592 and 602 of locking latch members 590 and 600. Furthermore, the continued movement of slider plate 570 causes latch members 590 and 600 to be simultaneously moved therewith, due to the contact between protrusion/flange 573 of slider plate 570 and surfaces 592/602.

In the preferred construction, upstanding protrusion or flange 573 is spaced away from surfaces 592 and 602 of locking latch members 590 and 600. In this way, a built-in time delay is effectively achieved for assuring that sloping cam surface 572 of slider plate 570 will contact sloping surface 581 of control plate 580 and move control plate 580 upwardly before protrusion/flange 573 contacts surfaces 592 and 602. As a result, the desired controlled movement and interactive, cooperating operation of these components is realized.

As discussed above, once control plate 580 has been moved upwardly into its second position, cavity or slot 584 which is formed directly adjacent post 586 and cavity or slot 585 which is formed adjacent post 587 are aligned with sidewalls 591 and 601 of locking latch members 590 and 600. As a result, locking latch members 590 and 600 are able to freely move longitudinally within housing 500, with sidewalls 591 and 601 advancing into cavities/slots 584/585. Furthermore, this longitudinal movement is easily attained due to the contact and movement between upstanding protrusion/flange 573 with surfaces 592 and 602 of latch members 590/600.

As protrusion/flange 573 contacts surfaces 592/602 of latch members 590/600 and slider plate 570 is moved further for causing latch members 590/600 to move therewith, zipper pull engaging elements 595/605 are removed from engagement with the zipper pulls mounted therein, thereby releasing the zipper pulls from locked engagement with housing 500. In addition, the release of the zipper pulls from the zipper pull receiving and holding zones 14 and 15 also causes blocking plates 610 to automatically move upwardly. This upward movement causes the zipper pulls to pop away from housing 500, while also enabling blocking plates 610 to move into blocking alignment with zipper pull engaging elements 595/605, thereby preventing latch members 590/600 from returning to their original position.

As discussed above in the other embodiments of the present invention, blocking plates 610 are mounted in cooperating relationship with zipper pull receiving and holding zone 14 and 15, with spring member 640 cooperatively associated therewith, for controlling the upward movement of blocking plates 610 into engagement with blocking latch members 590/600, when the zipper pulls have been removed therefrom. When in blocking engagement, side edges 611 of blocking plates 610 are in abutting contact with side edges 593/603 of engaging elements 595/605 of latch members 590/600.

In this way, latch members 590 and 600 are maintained in their open position, until the zipper pull is returned to receiving and holding zones 14 and 15, with the zipper pulls being inserted into the holding/receiving zones for forcibly moving blocking plates 610 downwardly against biasing force of spring member 640, releasing latch members 590/600 and enabling engaging elements 595/605 to be inserted into the aperture of each zipper pull. Thereafter, the zipper pulls are quickly and easily securely engaged with housing 500 when desired by the user.

In FIGS. 39A, 39B, 39C, 40A, and 40B, an alternate embodiment of blocking plates 610 is depicted for providing the blocking engagement of latch members 590/600 when the zipper pulls have been removed from engaging elements 595/605. In this alternate embodiment, blocking plates 610 incorporate an upstanding ridge or flange 611A which incorporates substantially flat, side surface 611B formed substantially perpendicularly to the top surface of blocking plates 610. In this way, a positive, abutment stop member is formed on blocking plates 610 in order to prevent the accidental movement of latching members 590/600 into the locking position when the zipper pull tabs are not present.

It has been found that during use, blocking plates 610 can be accidentally moved downwardly by the user when the zipper pull tabs have been released from housing 500. When this occurs, the user is inconvenienced since blocking plates 610 should be returned to the desired position wherein blocking plates 610 are in contact with engaging elements 595/605 of latching members 590/600 in order to maintain latching members 590/600 in the disengaged position. In order to eliminate the unwanted result of releasing latching members 590/600 from the desired position, blocking plates 610 may be constructed with upstanding ridge or flange 611A.

By incorporating upstanding ridge or flange 611A with abutment surface 611B inteqrally formed therein, a positive stop for latching members 590/600 is achieved. In this regard, whenever blocking plates 610 are accidentally moved for causing side edges 611 to be disengaged from side edges 593/603 of engaging elements 595/605 of latch members 590/600, side edges 593/603 contact abutment surface 611B of upstanding ridge/flange 611A, preventing latch members 590/600 from returning to the engaged or locking position. In this way, the user is able to employ the locking system of the present invention in the normal manner, without requiring further effort.

Whenever the user wishes to set or reset a desired combination on dials of 521, 522, and 523, the dials are positioned for causing slots 531*a*, 532*a*, and 533*a* of clutch plates 531, 532, and 533 to be aligned with finger members 541, 542, and 543 of locking plate 540. Once in this position, locking plate 540 automatically moves for engaging the finger members in the corresponding slots. When in this position, extension finger 545 of locking plate 540 moves out of blocking alignment with reset member 650.

As shown in the drawings, reset member 650 is cooperatively associated with a spring member for maintaining reset member in a first position, wherein reset member 650 is spaced away from finger 545. However, once locking plate 540 is moved into its clutch ring engaging position, reset member 650 can be moved against the biasing force of the spring member, causing wall portion 651 of reset member 650 to be moved into blocking engagement with finger 545. When in the second position, locking plate 540 is incapable of longitudinal movement and slots or notches of 531*a*, 532*a*, and 533*a* are maintained in engagement with protrusions 541, 542, and 543.

Once this fully engaged position has been achieved, the user is able to rotate dials 521, 522, and 523 into any desired position for displaying any particular indicia in the display zone, thereby establishing a desired combination. Once a desired combination has been set, reset member 650 is released and allowed to return to its original position, allowing locking plate 540 to be movable out of engagement with clutch rings 531, 532, and 533.

In addition to enabling locking system 10 of the present invention to be opened using combination controlled locking section 17, the present invention also enables locking system 10 to be opened using key controlled locking section 18. In this regard, whenever key controlled locking section 18 is employed, an appropriate key member is inserted into cylinder 510 in order to cause cylinder 510 to arcuately pivot about its central axis. In addition, cylinder 510 is cooperatively associated with cam plate 660 in order to cause cam plate 660 to arcuately pivot simultaneously therewith.

In the preferred construction, cam plate 660 incorporates radially extending flange 661 and radially extending finger 662, each of which are arcuately spaced away from each other. Furthermore, flange 661 is cooperatively associated with wall 589 of control plate 580. By employing this construction, the arcuate pivoting movement of cylinder 510 causes flange 661 to contact wall 589 of control plate 580 causing control plate 580 to be raised or moved upwardly from its first position into its second position. As discussed above, when control plate 580 is in its second position, side walls 591 and 601 of locking latch members 590 and 600 are aligned with cavities/slots 584/585 of control plate 580, enabling latch members 590/600 to longitudinally move relative thereto.

In addition, radially extending finger 662 of cam plate 660 is constructed for contacting terminating edges 594 and 604 of locking latch members 590 and 600. Furthermore, the radial position of finger 662 relative to flange 661 is constructed to assure that finger 662 contacts terminating edges 594 and 604 only after control plate 580 has been raised into its second position.

In this way, the arcuate pivoting movement of cylinder 510 causes finger 662 to contact terminating edges 594 and 604 of latch members 590 and 600 and cause latch members 590 and 600 to longitudinally move relative to housing 500 as the arcuate pivoting movement of cylinder 510 continues. In this way, key controlled locking section 18 of locking system 10 is easily and effectively employed in order to release any zipper pulls mounted in the zipper pull receiving and holding zones 14 and 15. Furthermore, as detailed above, once the zipper pulls are released, locking plates 610 are automatically raised causing the zipper pulls to pop away from receiving and holding zones 14 and 15, while also effectively blocking latch members 590 and 600 from returning to the locked position.

As a further feature of this embodiment of the present invention, the key employed to arcuately pivot cylinder 510 is constructed for being withdrawn from cylinder 510 once the zipper pulls have been released from housing 500. In this way, the present invention is capable of meeting and complying with the recently enacted legislation regarding the removability of keys from cylinders during inspections.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to the understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A dual-mode padlock system constructed for locking two cooperating zipper pull tabs to a product upon which a zipper assembly is mounted, said system comprising:

A. a housing incorporating a key controlled locking assembly and a combination controlled locking assembly, each being mounted in the housing for locking and unlocking operation independently of each other;

B. a first zipper pull tab receiving zone and a second zipper pull tab receiving zone formed in the housing in cooperating relationship with each other and constructed for enabling each zipper pull tab to be independently positioned in one of said receiving zones for locking interengagement therein;

C. a first latching member positioned in cooperating relationship with the first zipper pull tab receiving zone and constructed for being movable between locking interengagement with a first zipper pull tab and unlocking release of said first zipper pull tab;

D. a second latching member positioned in cooperating relationship with the second zipper pull tab receiving zone and constructed for being movable between locking interengagement with a second zipper pull tab and unlocking release of said second zipper pull tab;

E. a control plate mounted in the housing for movement therein in response to the activation of the key controlled locking assembly or the combination controlled locking assembly and constructed for causing the first latching member and the second latching member to become disengaged from the zipper pull tabs associated therewith whenever activated; and F. said combination controlled locking assembly being further defined as comprising:

a) a plurality of dials mounted to the housing with each of said dials having a plurality of separate indicia bearing zones formed thereon, b) each of the dials also incorporating a receiving slot formed therein, and mounted in substantially side-to-side relationship with each other for rotational movement about cooperating, parallel axes c) a locking plate incorporating a substantially flat plate and cooperatively associated with the plurality of dials and incorporating a plurality of flanges formed thereon and positioned for sliding interengagement into the slots of each of the dials when the dials are in the desired, predetermined position, d) said locking plate being further defined as comprising a blocking member associated therewith and positioned for movement relative to the control plate, thereby blocking the movement of the control plate whenever the locking plate is incapable of movement in the housing and enabling movement of the control plate whenever the locking plate is able to move into engagement in the slots of the dials when the dials are in the desired, predetermined position, e) an activating member formed on a slider plate for movement therewith and positioned for cooperating with the control plate for enabling the control plate to be moved in the housing for causing the first latching member and the second latching member to become disengaged from the zipper pull tabs associated therewith whenever the dials are in the desired, predetermined position, and f) said blocking member being further defined as being mounted between the locking plate and the control plate, movable between a blocking position and a released position, and comprising one selected from the group consisting of a steel ball, a cylindrical rod, a metal roller, and a pin;

whereby a padlock system is achieved which securely affixes the two cooperating zipper pull tabs mounted to the product and enables the zipper pull tabs to be released in response to the activation of either the combination controlled locking assembly or the key controlled locking assembly.

2. The dual-mode padlock system defined in claim 1, wherein the control plate is constructed for enabling the simultaneous removal of the first latching member and the second latching member from engagement with the first zipper pull tab and the second zipper pull tab whenever either the key controlled locking assembly or the combination controlled locking assembly is properly activated.

3. The dual-mode padlock system defined in claim 2, wherein said control plate is responsive to the movement of an activation button or plate for simultaneously disengaging the first and second latching members from the first and second zipper pull tabs.

4. The dual-mode padlock system defined in claim 1, wherein the first latching member comprises a first flange mounted thereto and constructed for controlled sliding engagement and disengagement in an aperture formed in the first zipper pull tab for locking and releasing the first zipper pull tab from locked interengagement in the first zipper pull tab receiving zone of the housing, and the second latching member comprises a second flange mounted thereto and constructed for controlled sliding engagement and disengagement in an aperture formed in the second zipper pull tab for locking and releasing the second zipper pull tab from locked interengagement in the second zipper pull tab receiving zone of the housing.

5. The dual-mode padlock system defined in claim 4, wherein the first latching member and the second latching member are spring-biased for being normally maintained in locked engagement with the first zipper pull tab and the second zipper pull tab.

6. The dual-mode padlock system defined in claim 1, wherein the key controlled locking assembly is further defined as comprising:

a) a cylinder assembly mounted in the housing and incorporating a key receiving slot cooperatively associated with a plurality of tumblers for preventing the rotation movement of said cylinder assembly whenever the designated key member is not present and enabling the rotational movement of the cylinder assembly in response to the insertion of the designated key member in the slot, b) at least one flange mounted to a terminating end of said cylinder assembly and positioned in cooperating, movement controlling relationship with the control plate for causing the control plate to move relative to the housing whenever the cylinder assembly is rotated in response to the presence of the designated key member in the key receiving slot, said movement allowing the first latching member and the second latching member to become disengaged from the first zipper pull tab and the second zipper pull tab, and c) said cylinder assembly being constructed for enabling the designated key member to be removed from the key receiving slot when the first latching member and the second latching member are disengaged from the first zipper pull tab and the second zipper pull tab as well as when the first latching member and the second latching member are engaged with the first zipper pull tab and the second zipper pull tab.

7. The dual-mode padlock system defined in claim 1, wherein said locking plate is further defined as being engaged with the control plate for causing the movement of the control plate relative to the housing whenever the dials are in the desired, predetermined position.

8. The dual-mode padlock system defined in claim 1, wherein activation of either the key controlled locking assembly or the combination controlled locking assembly causes the control plate to be moved in a first direction relative to the housing, thereby causing the control plate to be moved from its first position to its second position and allowing the first latching member and second latching member to move in a second direction perpendicular to said first direction.

9. A dual-mode padlock system constructed for locking two cooperating zipper pull tabs to a product upon which a zipper assembly is mounted, said system comprising:

A. a housing incorporating a key controlled locking assembly and a combination controlled locking assembly, each being mounted in the housing for locking and unlocking operation independently of each other;

B. a first zipper pull tab receiving zone and a second zipper pull tab receiving zone formed in the housing in cooperating relationship with each other and constructed for enabling each zipper pull tab to be independently positioned in one of said receiving zones for locking interengagement therein;

C. a first latching member positioned in cooperating relationship with the first zipper pull tab receiving zone and constructed for being movable between locking interengagement with a first zipper pull tab and unlocking release of said first zipper pull tab;

D. a second latching member positioned in cooperating relationship with the second zipper pull tab receiving zone and constructed for being movable between locking interengagement with a second zipper pull tab and unlocking release of said second zipper pull tab; and E. a control plate mounted in the housing for movement therein in response to the activation of the key controlled locking assembly or the combination controlled locking assembly and constructed for allowing the first latching member and the second latching member to become disengaged from the zipper pull tabs associated therewith whenever activated, wherein activation of either the key controlled locking assembly or the combination controlled locking assembly causes the control plate to be moved in a first direction relative to the housing, thereby causing the control plate to be moved from its first position to its second position and allowing the first latching member and second latching member to move in a second direction perpendicular to said first direction;

F. a first blocking plate cooperatively associated with the first zipper pull tab receiving zone for movement therein, and constructed a) for automatic movement from a disengaged position with the first latching member when said first latching member is engaged with the first zipper pull tab, into an engaged position with the first latching member whenever the first zipper pull tab is removed therefrom; and b) also constructed for enabling the first latching member to automatically return into engagement with the first zipper pull tab whenever the first zipper pull tab is inserted into the first zipper pull tab receiving zone for dislodging the first blocking plate, and G. a second blocking plate cooperatively associated with the second zipper pull tab receiving zone for movement therein, and constructed a) for automatic movement from a disengaged position with the second latching member whenever said second latching member is engaged with the second zipper pull tab, into an engaged position with the second latching member whenever the second zipper pull tab is removed therefrom; and b) also constructed for enabling the second latching member to automatically return into engagement with the second zipper pull tab whenever the second zipper pull tab is inserted into the second zipper pull tab receiving zone for dislodging the second blocking plate;

whereby the first latching member and the second latching member are maintained in an open position whenever the first zipper pull tab and the second zipper pull tab are disengaged therefrom, and remain in the open position until the first zipper pull tab and the second zipper pull tab are reinserted for locked interengagement therewith.

10. The dual-mode padlock system defined in claim 9, wherein said first blocking plate and said second blocking plate each comprise a side edge constructed for abutting contact with a side edge of the latching member for providing the desired holding engagement of the first latching member and the second latching member in a disengaged position when the first zipper pull tab and the second zipper pull tab are disengaged therefrom.

11. The dual-mode padlock system defined in claim 10, wherein said first blocking plate and said second blocking plate are each further defined as comprising an upstanding flange or ridge mounted thereto and incorporating an abutment surface positioned for direct, contacting engagement with the side edge of the associated latching member for providing a secondary contact surface for engaging the side edge of the latching member whenever the side edge of the latching member is disengaged from the side edge of the blocking plate.

12. A dual-mode padlock system constructed for locking two cooperating zipper pull tabs to a product upon which a zipper assembly is mounted, said system comprising:

A. a housing incorporating a key controlled locking assembly and a combination controlled locking assembly, each being mounted in the housing for locking and unlocking operation independently of each other;

B. a first zipper pull tab receiving zone and a second zipper pull tab receiving zone formed in the housing in cooperating relationship with each other and constructed for enabling each zipper pull tab to be independently positioned in one of said receiving zones for locking interengagement therein;

C. a first latching member positioned in cooperating relationship with the first zipper pull tab receiving zone and constructed for being movable between locking interengagement with a first zipper pull tab and unlocking release of said first zipper pull tab;

D. a second latching member positioned in cooperating relationship with the second zipper pull tab receiving zone and constructed for being movable between locking interengagement with a second zipper pull tab and unlocking release of said second zipper pull tab; and E. a control plate mounted in the housing for movement therein between a first blocking position and a second release position in response to the activation of the key controlled locking assembly or the combination controlled locking assembly and constructed for enabling the first latching member and the second latching member to become disengaged from the zipper pull tabs associated therewith whenever activated, said control plate being further defined as comprising:

a) a first post member cooperatively associated with the first latching member and a second post member cooperatively associated with the second latching member, said first post member and said second post member being in juxtaposed, spaced relationship with each other, b) said first post member being positioned for blocking the movement of the first latching member whenever the control plate is in its first blocking position, and the second post member being positioned for blocking the movement of the second latching member whenever the control plate is in its first blocking position, c) said first post member being removed from blocking the first latching member whenever the control plate is in its second release position, and the second post member being removed from blocking the second latching member whenever the control plate is in its second release position, thereby enabling the first latching member to be movable relative to the first zipper pull tab receiving zone and enabling the second latching member to be movable relative to the second zipper pull tab receiving zone, and wherein activation of either the key controlled locking assembly or the combination controlled locking assembly causes the control plate to be moved in a first direction relative to the housing, thereby causing the control plate to be moved from its first position to its second position and allowing the first latching member and second latching member to move in a second direction perpendicular to said first direction.

13. The dual-mode padlock system defined in claim 12, wherein the control plate comprises a sloping surface formed on the control plate and positioned for cooperating association with a cam surface formed on a slider plate which causes the control plate to move from its first position to its second position whenever the slider plate is activated.

14. The dual-mode padlock system defined in claim 13, wherein said control plate further comprises a wall cooperatively associated with the key controlled locking assembly, with said wall being constructed for lateral movement in response to rotational activation movement of said key controlled locking assembly, thereby causing the control plate to move from its first blocking position into its second release position.

15. The dual-mode padlock system defined in claim 12, wherein the control plate is responsive to the movement of an activation button or plate, and the movement of the combination controlled locking assembly enables the activation button or plate to be released for use.

* * * * *